US006216785B1

(12) United States Patent
Achee, Jr. et al.

(10) Patent No.: US 6,216,785 B1
(45) Date of Patent: Apr. 17, 2001

(54) SYSTEM FOR INSTALLATION OF WELL STIMULATING APPARATUS DOWNHOLE UTILIZING A SERVICE TOOL STRING

(75) Inventors: Timothy T. Achee, Jr., Charenton; Harold S. Bissonette, Lafayette; Charles M. Dancause, New Iberia, all of LA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/271,402

(22) Filed: Mar. 17, 1999

Related U.S. Application Data

(60) Provisional application No. 60/079,445, filed on Mar. 26, 1998.

(51) Int. Cl.[7] ..... E21B 43/04

(52) U.S. Cl. ..... 166/278; 166/51

(58) Field of Search ..... 166/278, 51, 127, 166/128

(56) References Cited

U.S. PATENT DOCUMENTS

| | | | | |
|---|---|---|---|---|
| 3,455,387 | | 7/1969 | Peters . | |
| 4,270,608 | * | 6/1981 | Hendrickson et al. | 166/278 |
| 4,372,384 | | 2/1983 | Kinney . | |
| 4,540,051 | | 9/1985 | Schmuck et al. . | |
| 4,541,486 | | 9/1985 | Wetzel et al. . | |
| 4,566,538 | | 1/1986 | Peterson . | |
| 4,700,777 | | 10/1987 | Luers . | |
| 4,969,524 | | 11/1990 | Whiteley . | |
| 5,174,379 | | 12/1992 | Whiteley et al. . | |
| 5,373,899 | | 12/1994 | Dore et al. . | |
| 5,579,842 | * | 12/1996 | Riley | 166/250.01 |
| 5,598,890 | | 2/1997 | Richard et al. . | |
| 5,845,712 | * | 12/1998 | Griffith, Jr. | 166/278 |
| 5,865,251 | * | 2/1999 | Rebardi et al. | 166/278 |
| 5,931,229 | * | 8/1999 | Lehr et al. | 166/278 |

* cited by examiner

*Primary Examiner*—William Neuder
(74) *Attorney, Agent, or Firm*—Maryan Bani-Jamali; Jeffrey E. Griffin

(57) ABSTRACT

A service tool string (34) is releasably attached to a bottom hole assembly (18) and forms a production string as well as a work string. The tool (35) has a mandrel (102) and a slide valve assembly (68) mounted on the mandrel for relative sliding movement. Crossover ports (114, 124) are provided in the mandrel (102) and the slide valve assembly (68). Slide valve assembly (68) moves by gravity and spring action when not contacted by the bottom hole assembly (18) to a position in which ports (114, 124) are blocked as shown in FIG. 7B. Upon contact of slidable valve assembly (68) with the bottom hole assembly (18), slide valve assembly is moved upwardly for alignment of ports (114, 124) as shown in FIGS. 5B and 6B. An equalizing valve (29) as shown in FIGS. 10–12 is effective to equalize the fluid pressure within the bottom hole assembly (18) with the fluid pressure outside the perforated casing section (23) so that in a reverse position as shown in FIG. 7B, the service tool (35) can be lifted to a position above the upper packer assembly (26) and above the bottom hole assembly (18). A diverter ball (132) seated on a ball catcher (134) is effective to divert the fracturing fluid outwardly through crossover ports (114, 124) as shown in FIG. 6B for downward flow through the annulus (27) into the formation adjacent the perforated casing section (23).

29 Claims, 13 Drawing Sheets

SYSTEM FOR INSTALLATION OF WELL STIMULATING APPARATUS DOWNHOLE UTILIZING A SERVICE TOOL STRING

REFERENCE TO RELATED APPLICATION

This application claims the benefit of provisional application 60/079,445 filed Mar. 26, 1998.

BACKGROUND OF THE INVENTION

1. Field of the Invention

This invention relates to a system including an apparatus and method for the installation of well stimulation apparatus downhole utilizing a service tool string for gravel packing a downhole formation, and more particularly to such a system in which the tool string forms the production string for production of the downhole formation to provide a one trip gravel pack and production system.

2. Background of the Invention

Heretofore, it has been common to provide well stimulating apparatus for fracturing a formation in which the apparatus is lowered within a well bore on the lower end of a service tool on a work string. The stimulating apparatus for hydraulic fracturing with a proppant, such as a sand slurry, may include a lower perforating gun which is utilized for perforating the well casing at the production zone, and a production screen or filter is then positioned. After perforation of the well casing, a gravel packing packer assembly is lowered by a service tool to a position where the production screen is adjacent the production zone. The packers are then set and the proppant is injected into the fissures of the formation upon actuation of a crossover tool member to open a crossover port for flow of the proppant downwardly in the annulus between the tool and casing to the perforated casing for fracturing the formation to increase the size of the fissures receiving the slurry. After injection of the proppant or hydraulic slurry into the producing zone and the actuation of the crossover tool member to block further downward flow, the service tool may be disconnected from the gravel packing packer assembly and the service tool string removed from the well by a suitable rig. Then, a production tubing string is lowered into the well and connected to the gravel packing packer assembly adjacent the upper packer for the production of a hydrocarbon fluid from the producing zone. The production tubing string is supported from a wellhead.

Such a process is time consuming and requires a rig for running in the production string and for removing the work string after the fracturing process has been completed. A single trip for a work string to provide perforation and sand control has commonly been used heretofore but the installation of production tubing has normally required a separate trip after the work string has been removed.

However, U.S. Pat. No. 5,174,379 dated Dec. 29, 1992 shows a sand packing system in which the well is perforated, gravel packed, and placed on production with a single trip of the tool string into the well. The system includes a crossover assembly having a closure mechanism operated to preclude downward fluid flow through the tool, to establish a downward slurry flow path, and to establish a carrier fluid return flow path. At the end of the gravel pack operation, the tool string is placed on production without tripping the tool string.

The '379 patent includes a crossover assembly that is effective to provide a first flow path from the interior of the tubing string at a location above the packer to the wellbore annulus below the packer, and is selectively operable to provide a second flow path from the interior of the tool string below the packer to the annulus in the wellbore above the packer. The operating mechanism associated with the crossover assembly includes a probe or dart assembly which is lowered into the well after the crossover assembly is in the well. A wireline is normally utilized for removal of the probe.

SUMMARY OF THE INVENTION

The present invention discloses, a sand control completion system utilizing only one trip for the tool string which is placed on production after the perforation and gravel pack operations. Production tubing is used for the work string in the sand control completion system and is then used as the production string.

The tool utilizes only one flow path and provides for hydraulic fracturing as well as perforating in a single trip. The use of a single flow path permits relatively large internal diameters to be utilized which is desirable for high volume hydraulic fracturing. A fluid diversion ball or probe is pumped down the tool with the slurry for the gravel pack operation and is effective to divert the fracturing fluid through aligned crossover ports from the interior of the tool string to the annulus for flow out the perforated casing section at the production zone for fracturing the formation.

A gravel packing packer assembly includes a slidable sleeve mounted below the gravel pack packer. This slidable sleeve is alignable with a crossover port in the service tool housing when the crossover port is in a retracted crossover position. The crossover port is movable between an extended position in which the weight of the crossover port and force of the spring maintains the crossover port in an extended relation at the end of the service tool with the crossover ports out of alignment, and a retracted position in which the crossover port assembly contacts the gravel pack packer assembly and is moved to the retracted position in which the crossover ports are in alignment. The crossover port contacts the top of the gravel pack packer assembly for movement to the retracted position in the circulating position, and the secondary reverse position of the service tool.

In a reverse position for cleaning the interior of the tool string after the fracturing operation, the tool string is lifted above the upper packer and fluid flow down the annulus outside the tool is directed upwardly within the tool string to unseat the ball or probe for upward movement with the fluid for removal of the ball or probe without any separate step being required for removal. An equalizing valve adjacent the sand screen is effective to equalize the fluid pressure within the bottom hole assembly and the fluid pressure outside the sand screen is the reverse position of the tool.

After the fracturing and reversing steps have been completed, the tool string is raised to the position at which a surface controlled subsurface safety valve is required and the subsurface safety valve is installed. Then the tool string is run back to the gravel packing packer assembly with the service tool assembly acting as production seals and placed in a sealing relation within the gravel pack packer. Then, a tubing hanger may be landed for production. Thus, the tool string of the present invention forms the production string and the seal assembly on the tool string which is effective for the crossover assembly also functions as the production seal assembly.

Suitable monitoring apparatus may be provided to monitor the gauge pressure downhole during the hydraulic fracturing. After the hydraulic fracturing, suitable monitoring apparatus such as electromagnetic and telemetric devices may be utilized for permanent monitoring of selected parameters.

An object of the present invention is to provide a system to perforate, pack, and place a well on production with only a single trip of the work string which also functions as the production string.

Another object is to provide a work string for gravel packing of a well with the work string being a production string after packing of the well.

Another object is to provide such a system in which the lower end of the service tool is positioned above the bottom hole assembly in the reverse position to allow unrestricted fluid flow from the annulus up the lower end of the service tool.

Another object is to provide such a system in which an equalizing valve in the bottom hole assembly permits equalizing of fluid pressure within the bottom hole assembly with fluid pressure outside the sand screen in the reverse position.

An additional object is to provide such a system which allows a surface controlled subsurface safety valve to be easily inserted within the work string after gravel packing of the well by raising the work string above the bottom hole assembly to the desired position of the subsurface safety valve.

Other objects, features, and advantages of the invention will be apparent from the specification and drawings.

DESCRIPTION OF THE INVENTION

Figure 1:
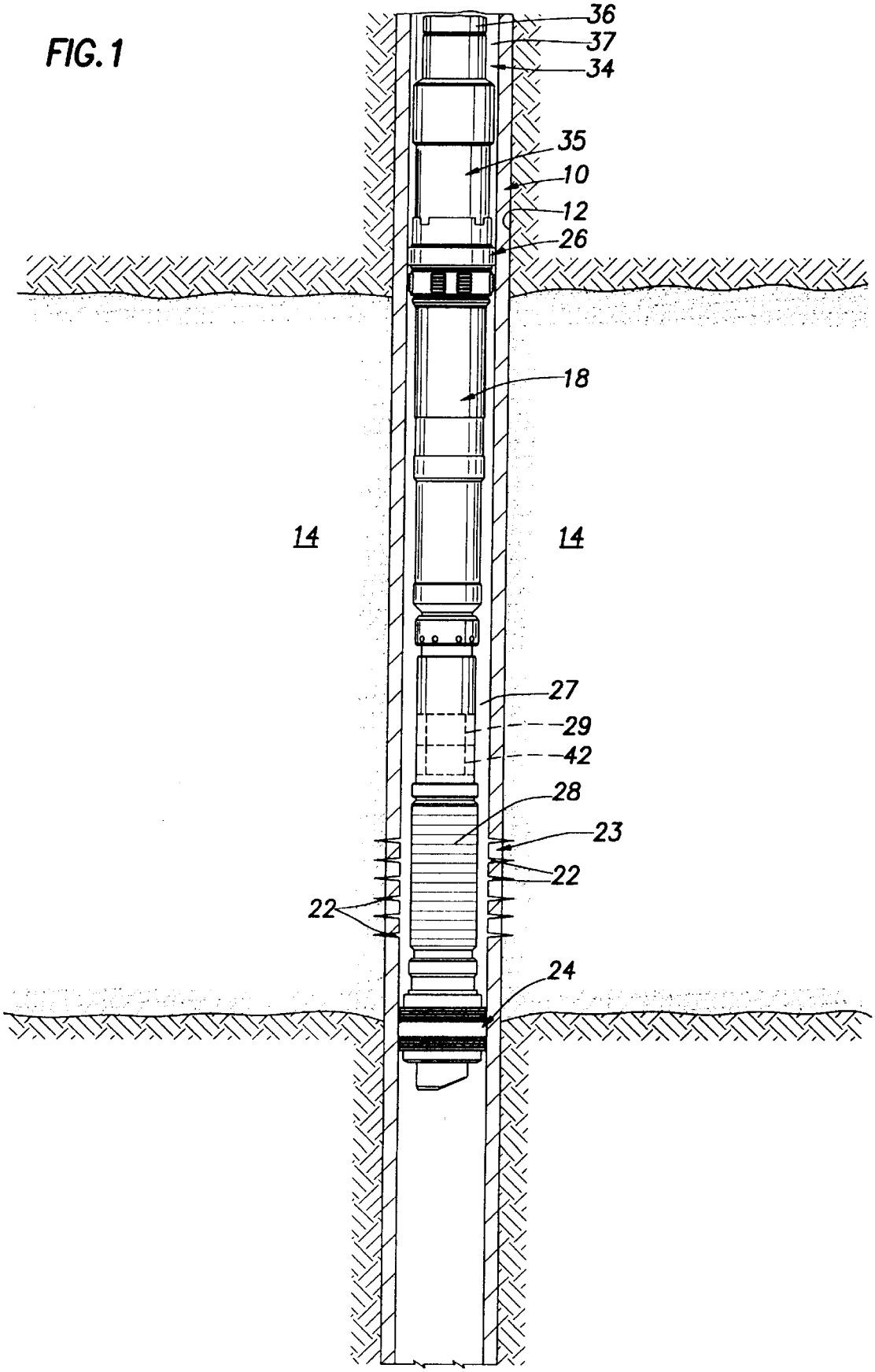
FIG. 1 is a schematic view of a bottom hole assembly for isolating a production zone and including a service tool releasably connected to the upper end of the bottom hole assembly.

Referring now to the drawings for a better understanding of the invention, and more particularly to FIG. 1, a casing 10 is shown mounted within a bore hole 12 in the earth formation having a production or zone of interest at 14. Casing 10 is normally secured by cement within borehole 12 as well known.

A bottom hole assembly shown generally at 18 is received within casing 10. Casing 10 has a perforated casing section 23 including perforations 22. Perforated casing section 23 is normally perforated by a separate perforating string having a perforating gun on its lower end prior to the insertion of bottom hole assembly 18.

Bottom hole assembly 18 include a lower, packer assembly generally indicated at 24 and an upper packer assembly generally indicated at 26 for isolation of the production zone 14. An annulus 27 is defined between bottom hole assembly 18 and casing 10. A gravel pack screen indicated at 28 is positioned between packers 24, 26 adjacent perforations 22. An equalizing valve is shown at 29 above screen 28 effective to equalize fluid pressure between the inner bore of bottom hole assembly 18 and annulus 27 outside screen 28. After the perforating of casing section 23, bottom hole assembly 18 is lowered to the position of FIG. 1 with lower packer assembly 24 and upper packer assembly 26 set as will be described further below. Lower packer assembly 24 designated a Model 18L or "Quantum" type packer may be purchased from Dowell Schlumberger of Houston, Tex. Upper packer assembly 26 designated as a "Quantum" HS packer may also be purchased from Dowell Schlumberger of Houston, Tex.

A service tool string or work string shown generally at 34 suspends bottom hole assembly 18 for installation and acts also as the production string after the gravel pack operation. Service tool string 34 includes a service tool 35 connected to the lower end of a tubing string 36. An upper annulus 37 is formed between tubing string 36 and casing 10. At the completion of the perforating and gravel packing operation, production commences directly through the service tool string 34 without removal or substitution of the service tool string 34. Thus, tool string 34 is arranged for completion of the entire gravel pack operation and for sealing against bottom hole assembly 18 for production. By utilizing the tool string 34 as both a work string and a production string for a sand control completion system, a one trip sand control run can be made with production tubing for the work string.

Such an arrangement eliminates a trip commonly utilized heretofore where a service tool string has been utilized for well completion and then removed from the well with a separate production string with production seals run in the well in a separate trip for production.

Figure 2A:
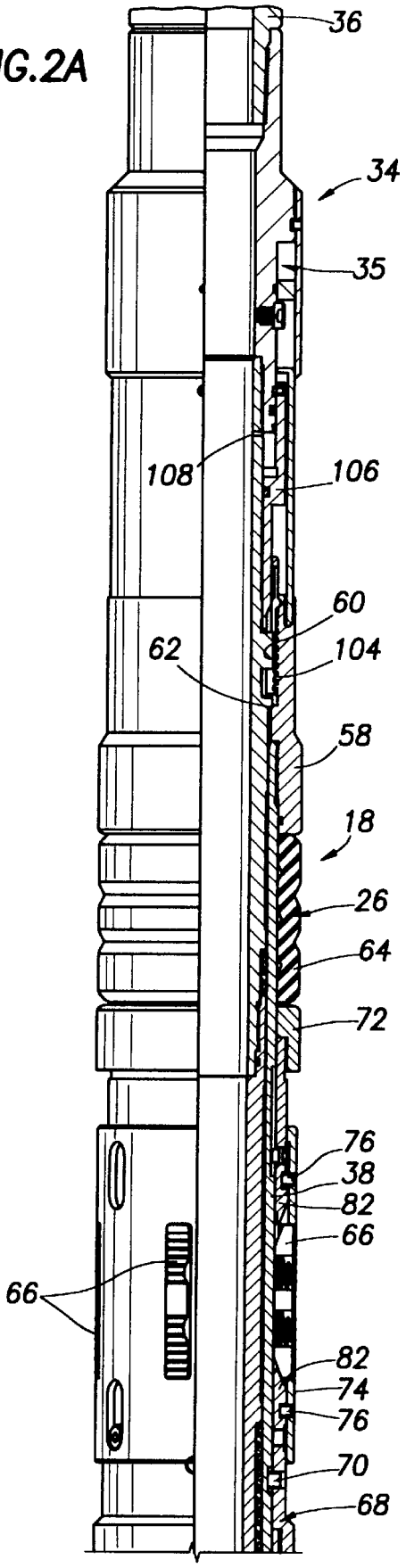
FIGS. 2A–2D are sectional view in sequence of the service tool mounted within the upper portion of the bottom hole assembly shown in FIG. 1.
Figure 2B:
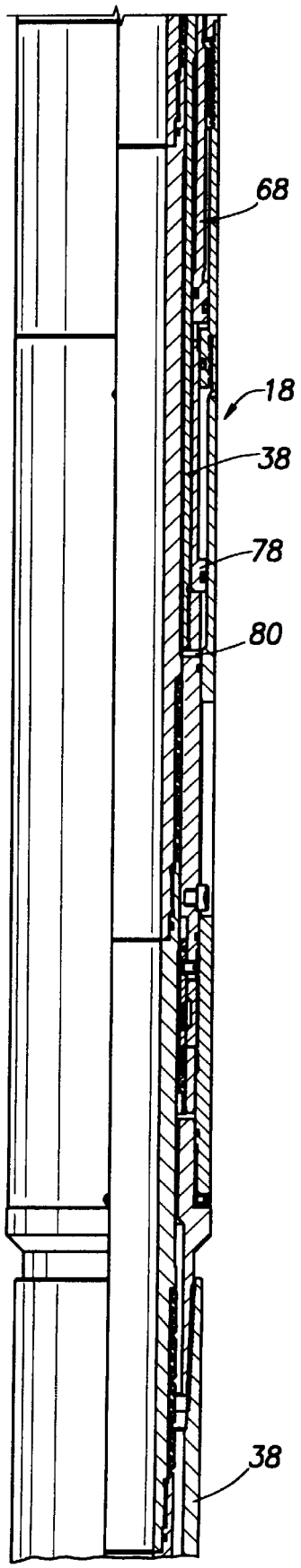
Figure 2C:
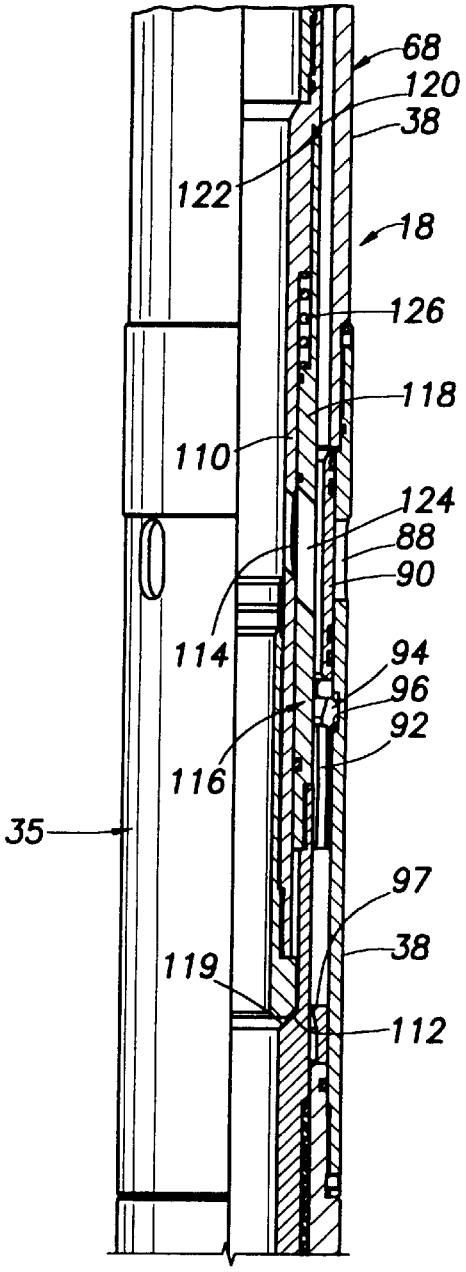
Figure 2D:
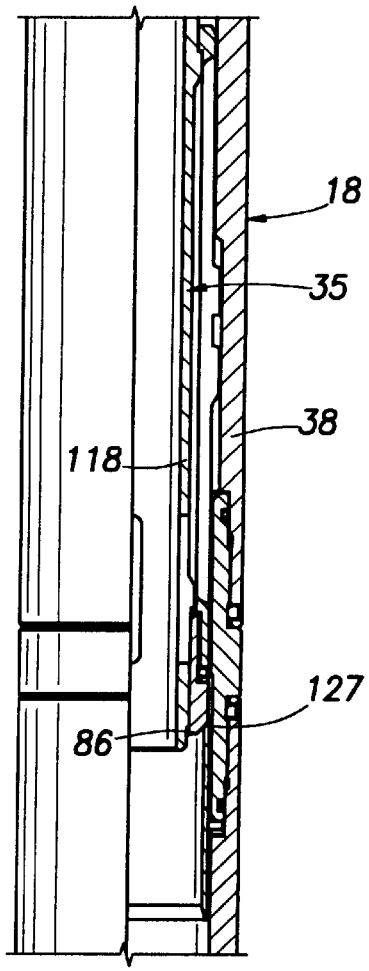
Figure 2E:
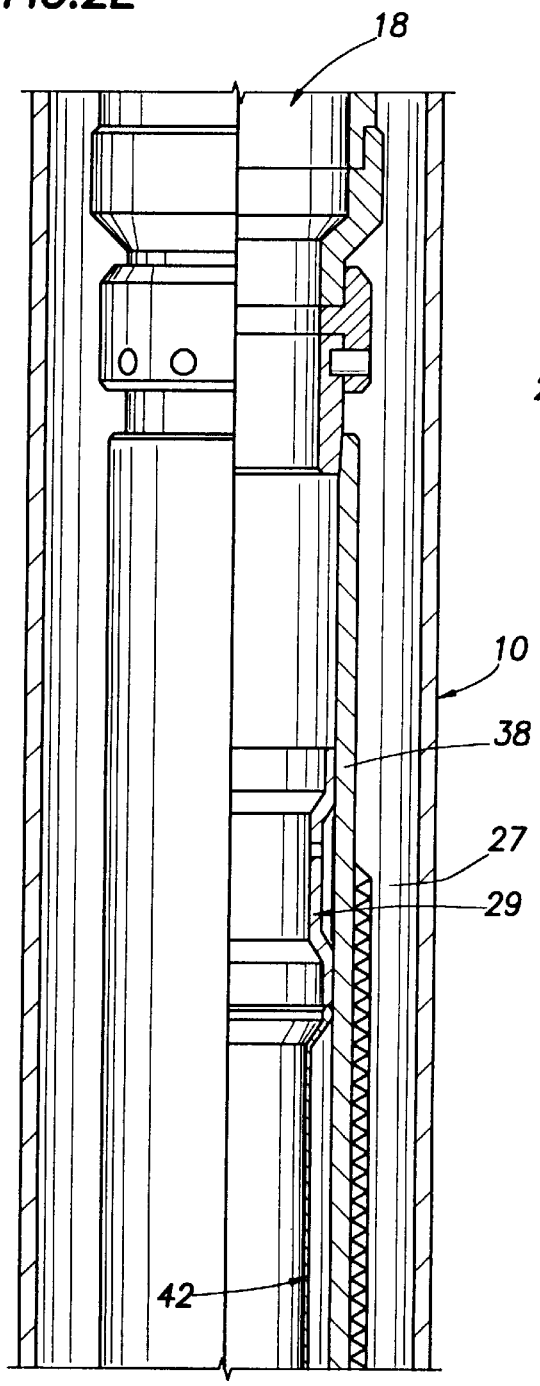
FIGS. 2E and 2F are sequential sectional views of the lower portion of the bottom hole assembly shown in FIG. 1 mounted within a perforated casing section and including a sump packer and production string with an equalizing valve.
Figure 2F:
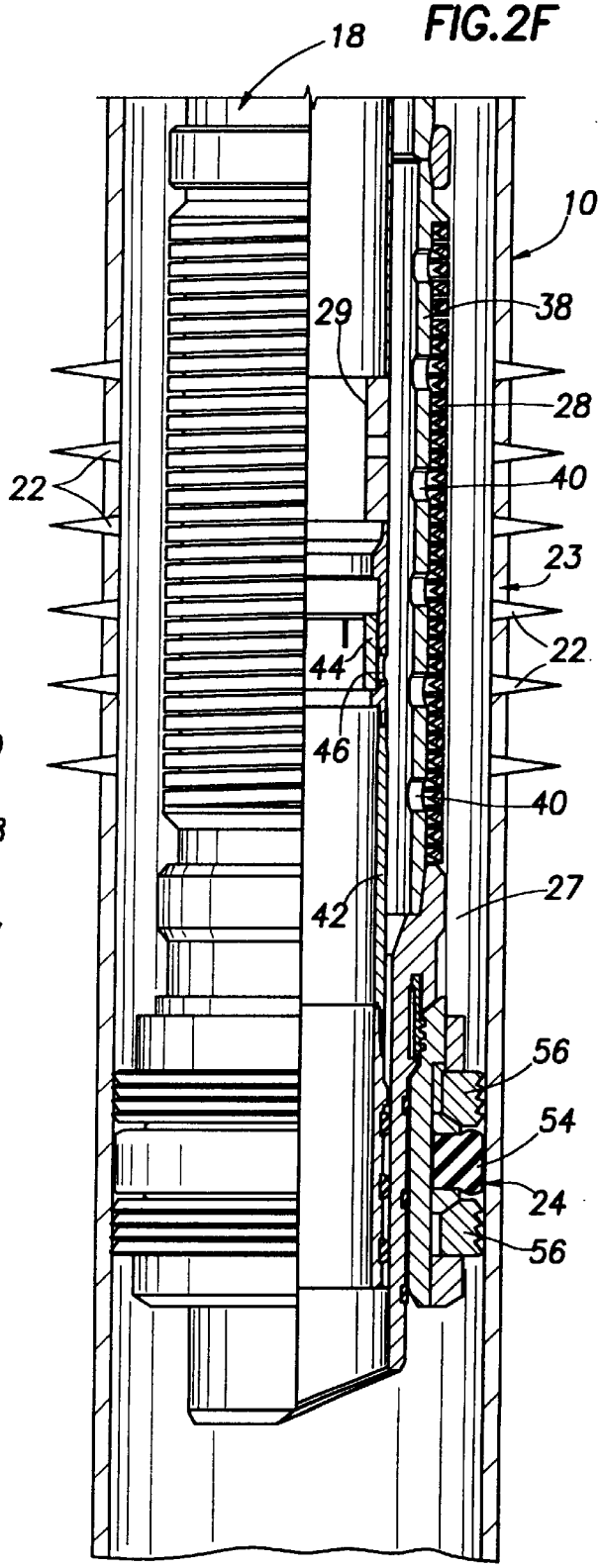
Figure 9A:
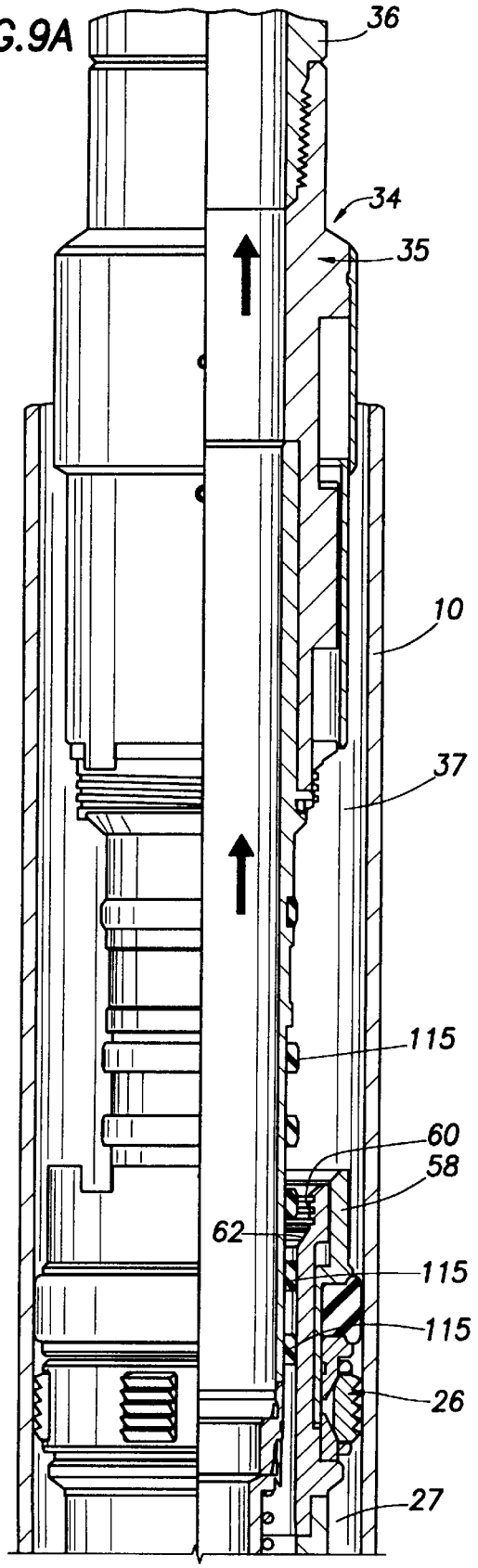
FIGS. 9A and 9B are sequential sectional views of the service tool mounted within the bottom hole assembly in a final position for production with a production seal assembly on the service tool shown in sealing relation with the bottom hole assembly.
Figure 9B:
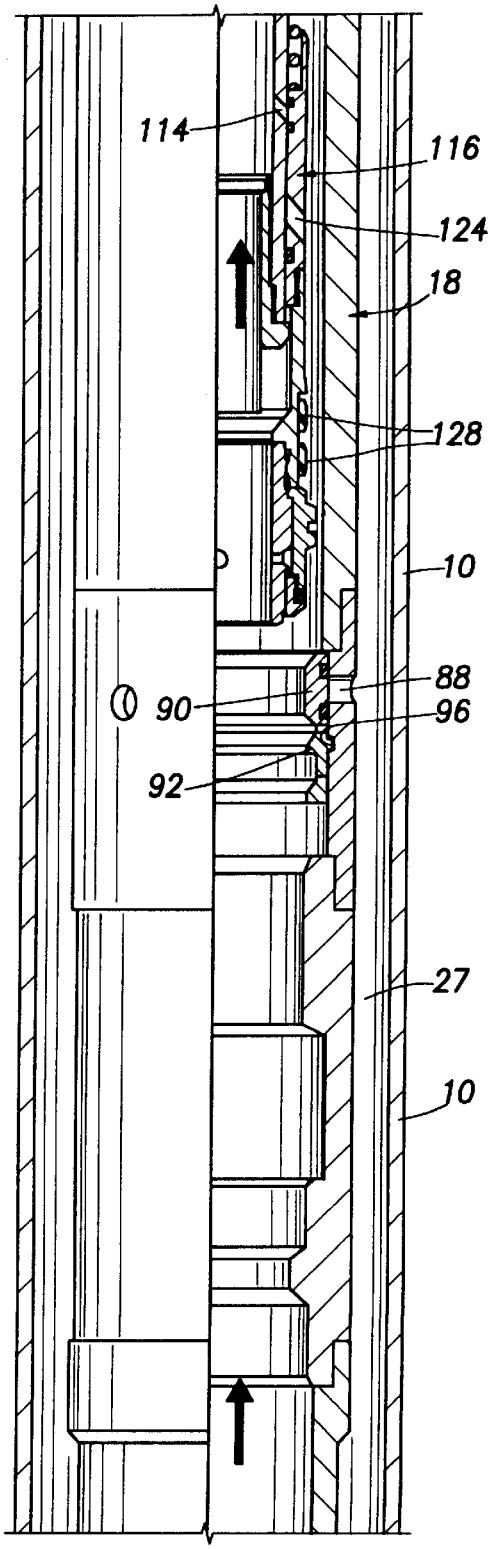

Referring now to FIGS. 2E and 2F, the lower portion of bottom hole assembly 18 is shown adjacent the perforated casing section 23. Bottom hole assembly 18 has an outer housing 38 forming outer annulus 27 with outer casing 10. Housing 38 has perforations 40 adjacent a sand screen 43. An inner slidable isolation sleeve 42 is received within housing 38 and has a slide valve 44 over openings 46 in sleeve 42. Slide valve 44 remains in a closed position over openings 46 until tool string 34 is utilized as a production string for product flowing through screen 42 as shown in FIGS. 9A and 9B. Slide valve 44 is moved mechanically to open position when the tool string is utilized as a production string by a shifting tool via slick line or coiled tubing. The sliding sleeve may be opened and closed repeatedly. Equalizing valve 29 is also mounted on the upper end portion of slidable sleeve 42 and will be explained further in FIGS. 10–12 for the reverse position of tool 35.

Lower packer assembly 24 forms a sump packer including an elastomeric packer member 54 and slips 56 set against casing 10 for the lower end of annulus 27. As indicated previously, lower packer assembly 24 is sold as a Model 18L or "Quantum" type packer by Dowell Schlumberger of Houston, Tex.

Figure 3A:
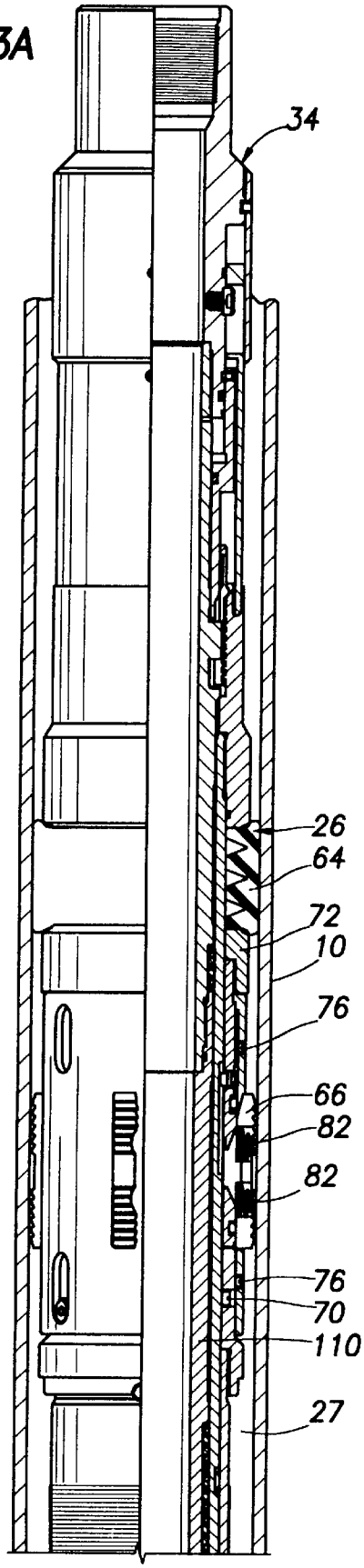
FIGS. 3A and 3B are sequential sectional views of the service tool hydraulically connected to the bottom hole assembly with the upper packer and slips in engagement with the casing for sealing the annulus.
Figure 3B:
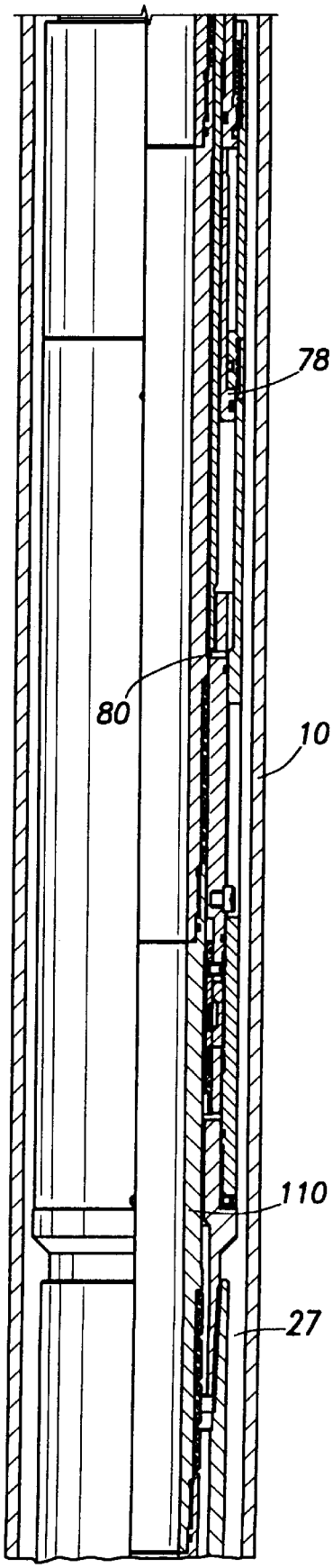

Referring now particularly to FIGS. 2A–2D, the upper portion of bottom hole assembly 18 is shown releasably connected to service tool 35 which is inserted within bottom hole assembly 18. Bottom hole assembly 18 which includes outer housing 38 has an upper packer sub 58 with internal threads 60 and an upper annular shoulder or abutment 62 adjacent threads 60 acts as a stop engaging tool string 34 when tool string 34 is releasably connected to bottom hole assembly 18. upper packer assembly 26 of bottom hole assembly 18 includes an elastomeric packer member 64 and slips 66. A slidable actuating sleeve assembly 68 is secured to housing 38 by shear pins 70. An upper ring 72 is provided adjacent elastomeric packer member 64. An outer sleeve 74 is secured to slidable sleeve assembly 68 by shear pins 76 adjacent slips 66. A fluid piston 78 shown in FIG. 2B is selectively energized through port 80 from internal fluid pressure. Wedge members 82 on slidable sleeve assembly 68 are positioned adjacent slips 66. For setting packer assembly 26, the fluid pressure down service tool string 34 is increased to a predetermined amount and exerted against piston 78 for shearing of shear pins 70, and thus applies a load through sleeve 74 into ring 72 for engaging and squeezing elastomeric packer member 64 into sealing relation with casing 10. Then upon a further increase in fluid pressure in service tool string 34 to a higher predetermined amount, shear pins 76 are sheared with wedge members 82 camming slips 66 radially outward for biting into casing 10 thereby to set packer assembly 26 as shown in FIGS. 3A and 3B for isolation of production zone 14 as well known. U.S. Pat. No. 4,862,957 dated Sep. 5, 1989, the entire disclosure of which is incorporated herein for all purposes, shows a suitable upper packer assembly and hydraulic release for the service tool. As indicated above, a suitable upper packer assembly is sold as a "Quantum" HS packer by Dowell Schlumberger of Houston, Tex.

Housing 38 of bottom hole assembly 18 has a lower annular abutment 86 as shown in FIG. 2D which acts to actuate a crossover valve sleeve for tool 35 as will be explained further. Housing 38 as shown in FIG. 2C has a laterally opening or port 88 therein and a slidable valve member 90 is positioned over openings 88 in a closed position. Slidable fingers 92 have upper ends 94 fitting in an annular groove 96 in housing 38 in the closed position of port 88. For opening of port 88 in a crossover position, abutment 97 is engaged by tool 35 as will be explained further hereinafter for movement of slidable valve member downwardly with fingers 92 to open or uncover crossover port 88.

Service tool 35 is shown in FIGS. 2A–2D releasably connected to bottom hole assembly 18. As shown particularly in FIG. 2A, tool 35 is received within upper packer sub 58 and has external threads 104 on collet fingers engaging internal threads 60 of upper packer sub 58. A release piston 106 is actuated by external pressure and internal port 108 vents the pressurized fluid allowing piston 106 to move upwardly for a hydraulic release of tool 35 from bottom hole assembly 18 if desired. A suitable hydraulic release and locator assembly is sold as a "Quantum" hydraulic release assembly by Dowell Schlumberger of Houston, Tex.

As shown particularly on FIGS. 2C and 2D, a mandrel 110 of service tool 35 has a lower end 112 and a crossover port 114 adjacent lower end 112. Production seals 115 are mounted about the outer periphery of mandrel 110. Crossover port 114 is formed through mandrel 110. Mounted about the outer periphery of mandrel 110 and extending downwardly from the lower end 112 of mandrel 110 is a crossover slide valve assembly generally indicated at 116 and forming an important feature of this invention. Slide valve assembly 116 includes an outer sleeve 118 having internal shoulder 119 for engaging mandrel end 112 in a retracted position of sleeve 118 shown in FIG. 2C. Sleeve 118 has an upper end 120 engaging an abutment 122 on mandrel 110. A crossover port 124 in sleeve 118 is aligned with crossover port 114 in mandrel 110 in the position of FIG. 2C. Slidable valve 90 in a closed position prevents communication of crossover ports 114, 124 with crossover port 88 in bottom hole assembly 18. Sleeve 118 has a lower shoulder 127 at its lower end and an adjacent shoulder 129 spaced upwardly from shoulder 127.

Figure 4A:
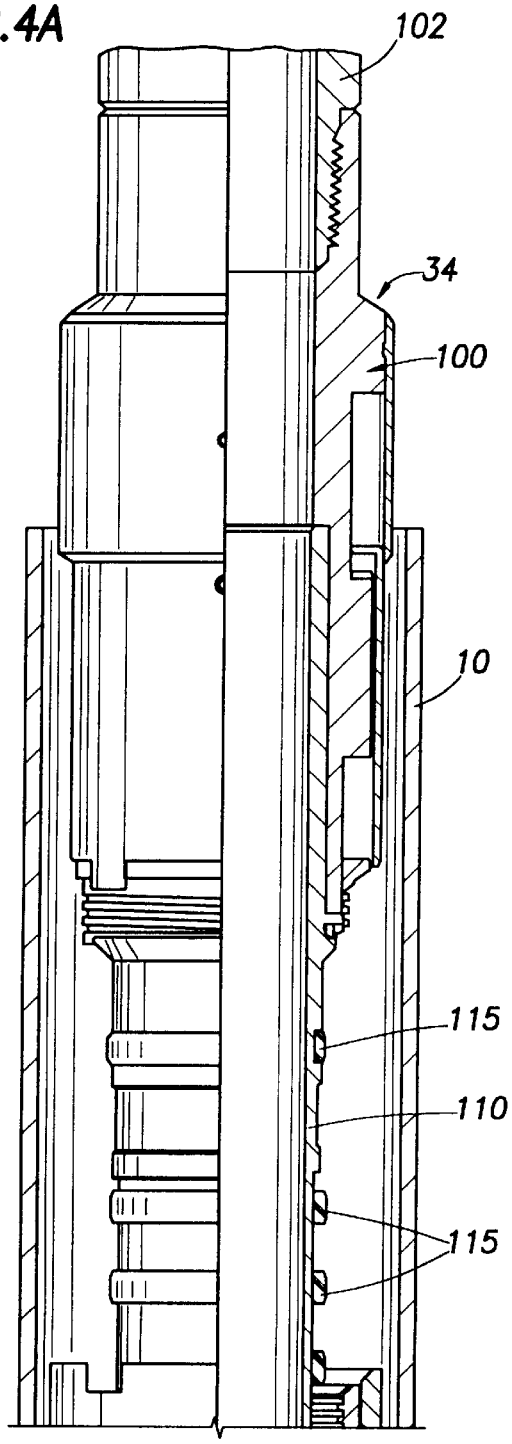
FIGS. 4A and 4B are sequential sectional views showing the service tool engaging the slidable sleeve mounted below the gravel pack packer, and moving a releasable slide valve ring into a closed position over the ports in the outer housing of the slidable sleeve.
Figure 4B:
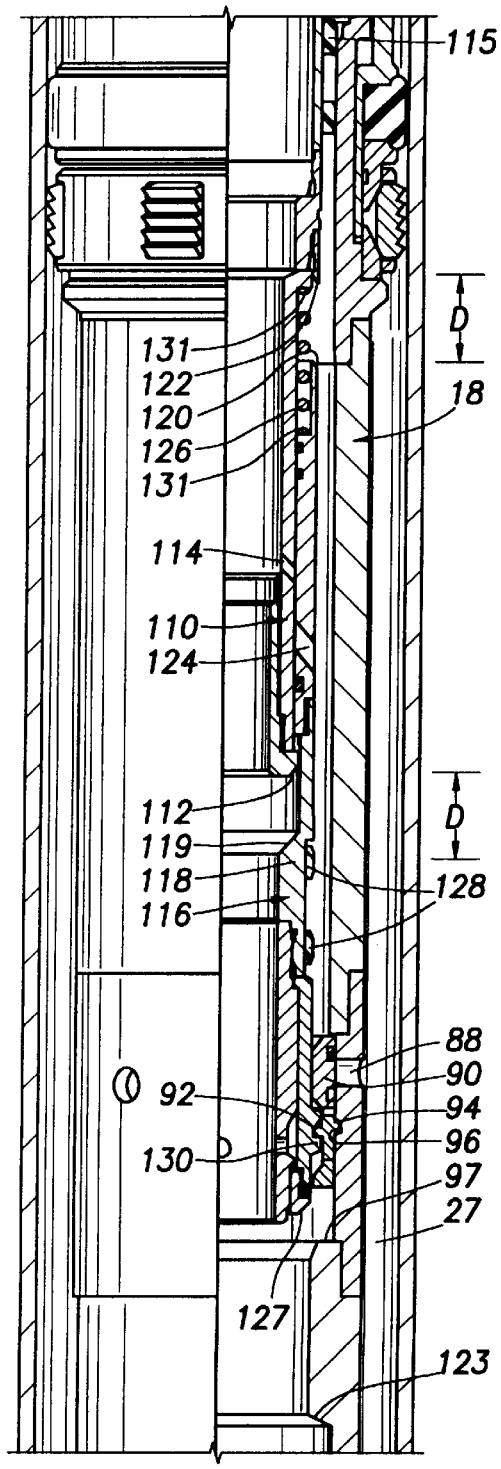

FIGS. 4A and 4B show slidable valve assembly 116 in an extended position. A spring 126 is biased between stops or abutments 131 on mandrel 110 and sleeve 118 of slidable valve assembly 116 to continuously urge valve assembly 116 to an extended position. The extended position of slide valve assembly 116 is shown also in FIGS. 8A, 8B and 9A, 9B as will be explained further. Slide valve assembly 116 is urged by resistance of collet fingers 130 on the lower shoulder 123 of bottom hole assembly 18 to the extended position and spring 126 merely assists slide valve assembly 116 in movement to an extended position when lower end 127 or shoulder 129 of slide valve assembly 116 are not engaged with an internal stop or abutment on bottom hole assembly 18 for movement to a retracted position. The travel distance between extended and retracted positions of slide valve assembly 116 relative to mandrel 110 is shown in FIG. 4B (and also FIGS. 7B, 8B) by distance D. Service seals 128 are provided about the outer periphery of sleeve 118. Also as shown in FIG. 4B, collet fingers 92 hold slide valve 90 in a closed position. Downward movement of service tool 35 from the position of FIG. 4B effects downward movement of collet fingers 92 into abutting relation with abutment 97 for downward movement of slide valve 90 and opening of crossover port 88 as shown in FIG. 6B. Downward movement of the service tool positions the recess of collet fingers 130 over lower shoulder of sleeve 90, engaging sleeve 90 until collet 130 is forced inward by the seal bore internal diameter of bottom hole assembly 18.

Figure 5A:
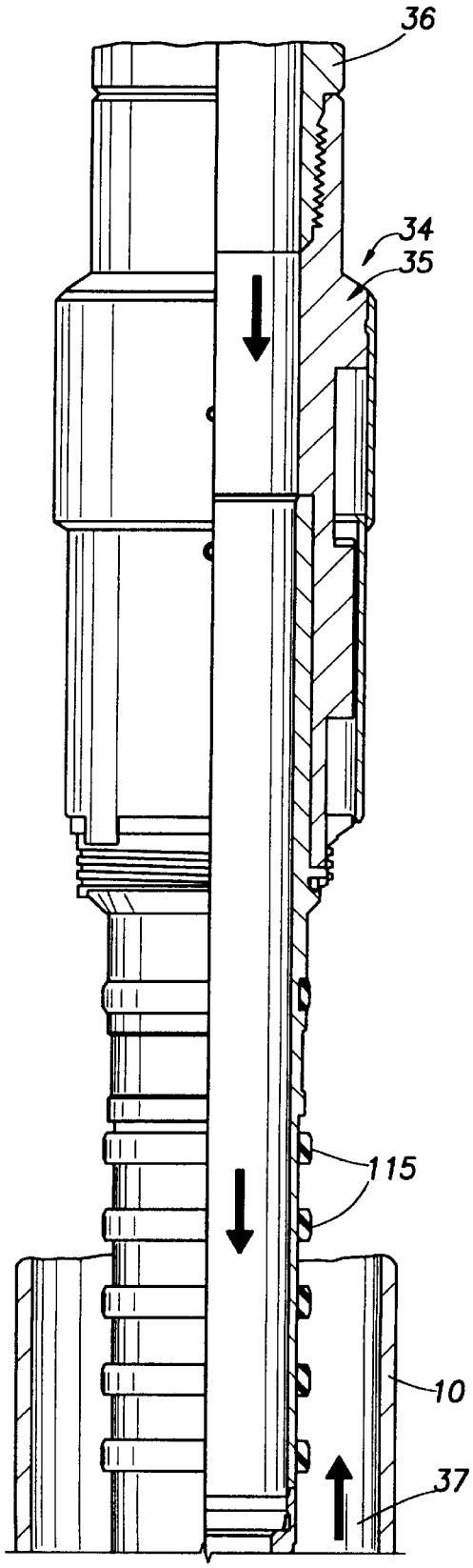
FIGS. 5A and 5B are sequential sectional views showing a circulating position of the service tool after a ball has been dropped down the tool string with a crossover port shown in open position for transverse alignment of the crossover ports in the tool string for directing the circulating fluid upwardly along the annulus.
Figure 5B:
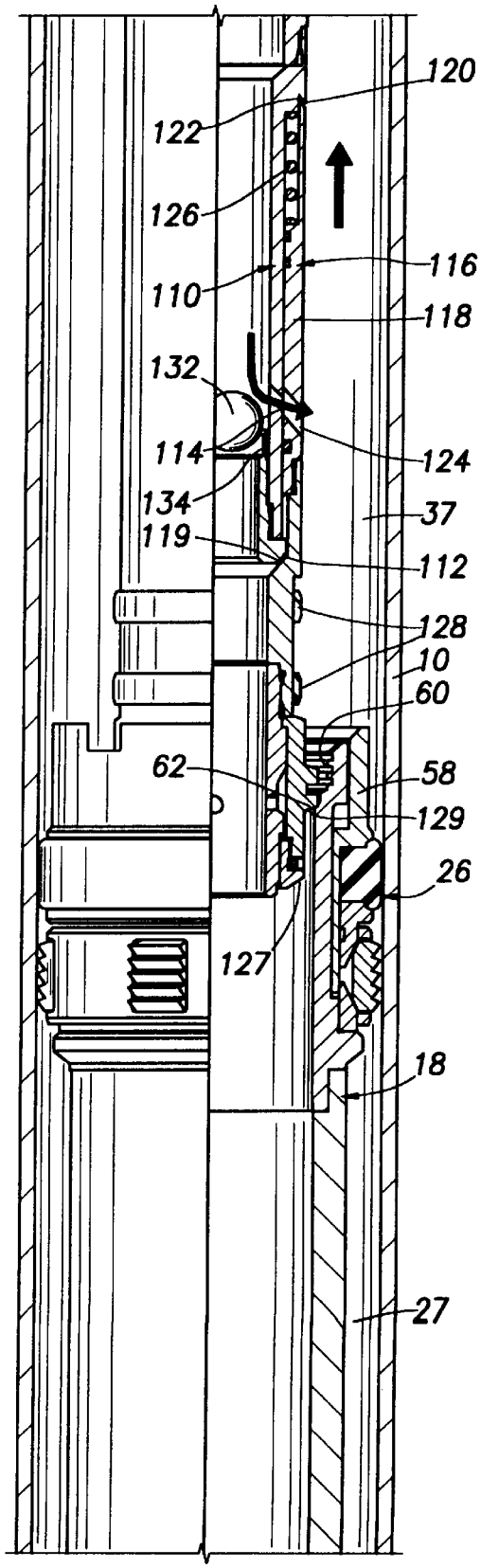

Referring now to FIGS. 5A and 5B, service tool 34 is shown in a circulating position prior to hydraulic fracturing. In the circulating position, the lower end of the slidable valve assembly 116 is seated on and engages inner shoulder 62 of bottom hole assembly 18 to move slide valve assembly 126 to a retracted position in which upper end 120 is in engagement with shoulder 122 on mandrel 110. Shoulder 119 on slide valve assembly 116 also is in engagement with end 112 of mandrel 110 in the retracted position. In the circulating position, ports 114 and 124 are in alignment at a location above the bottom hole assembly 18. A ball 132 is dropped down the bore of the service tool string 36 and seats on ball catcher 134 to block and divert fluid flow outwardly in annulus 37 between tool 35 and casing 10 for upward flow of fluid from annulus 37 for circulation.

Figure 6A:
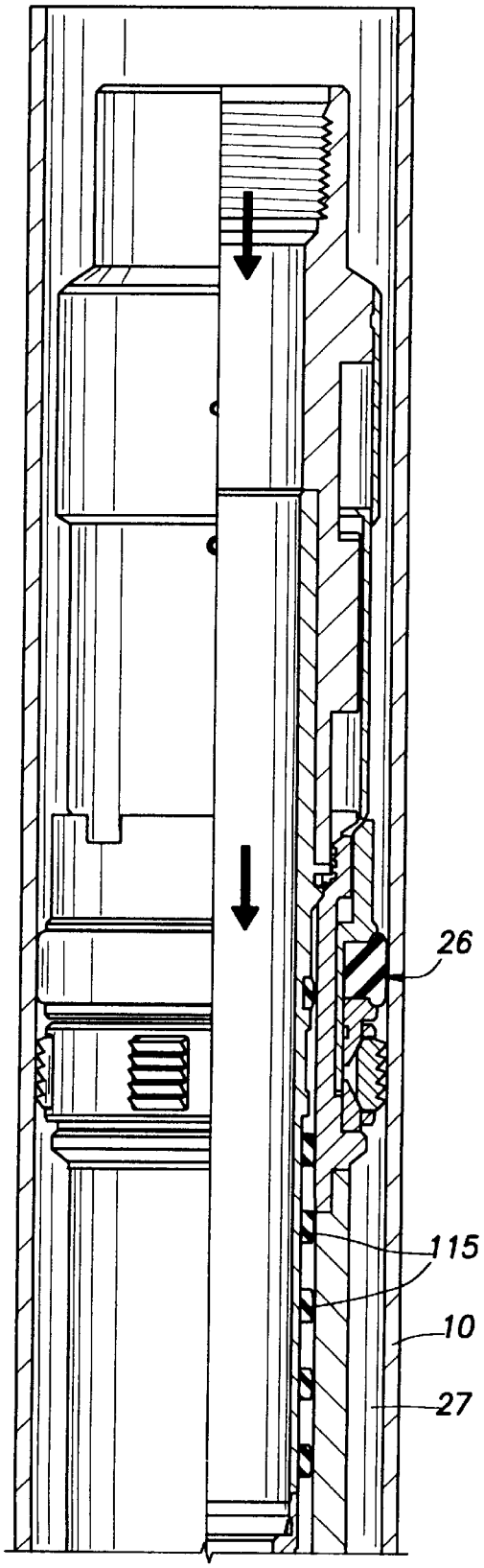
FIGS. 6A and 6B are sequential sectional views of the service tool in a squeeze position for fracturing formation by gravel packing of the production zone with the sliding sleeve of the service tool in alignment with the crossover port in the housing of the bottom hole assembly for directing the fracturing fluid down the annulus to the perforated casing section.
Figure 6B:
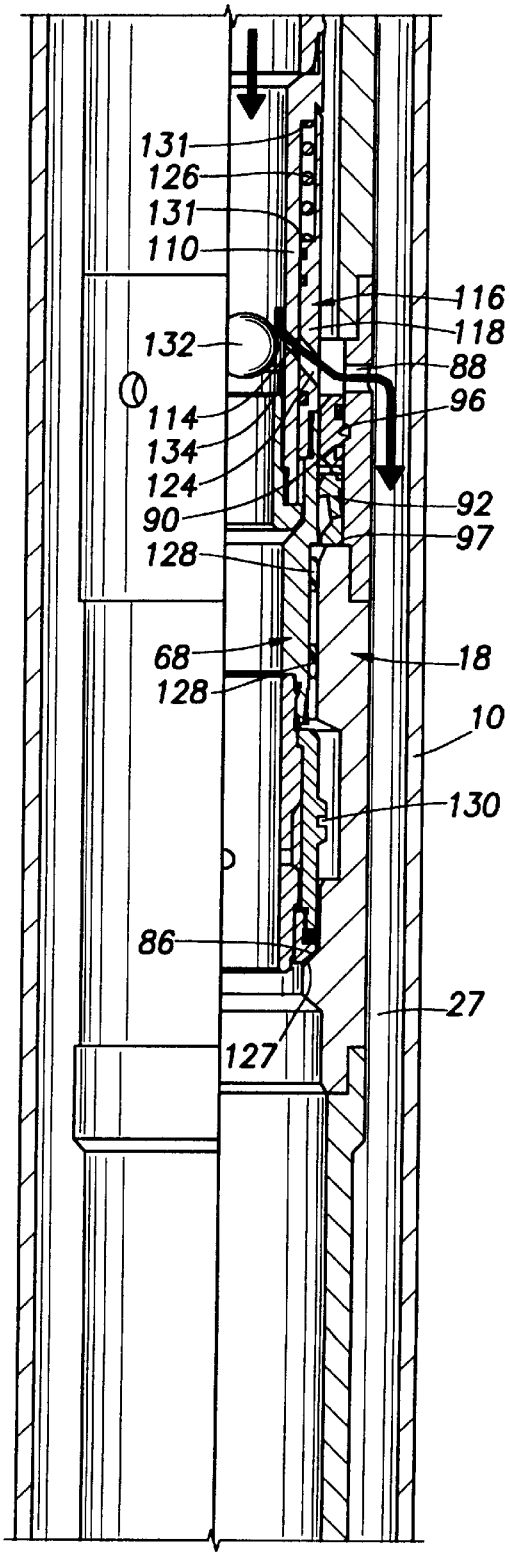

Next, referring to FIGS. 6A and 6B a squeeze position for hydraulic fracturing of formation 14 is shown. In the squeeze position, collet fingers 92 are cammed out of engagement with groove 96 by tool 35 and move downwardly against stop 97 to permit downward movement of slide valve 90 thereby to place crossover port 88 in communication with crossover ports 114 and 124. Annular shoulder 126 on slide valve assembly 116 engages abutment 86 on bottom hole assembly 18 to move slide valve assembly 116 to a retracted position in which ports 114 and 124 are in alignment. Annular seals 128 about sleeve 118 are in sealing engagement with bottom hole assembly 18. Collet fingers 92 have been moved downwardly against shoulder 97 by tool 35 for movement of slide valve 90 to an open position with crossover ports 114, 124 and 88 in aligned position.

Figure 7A:
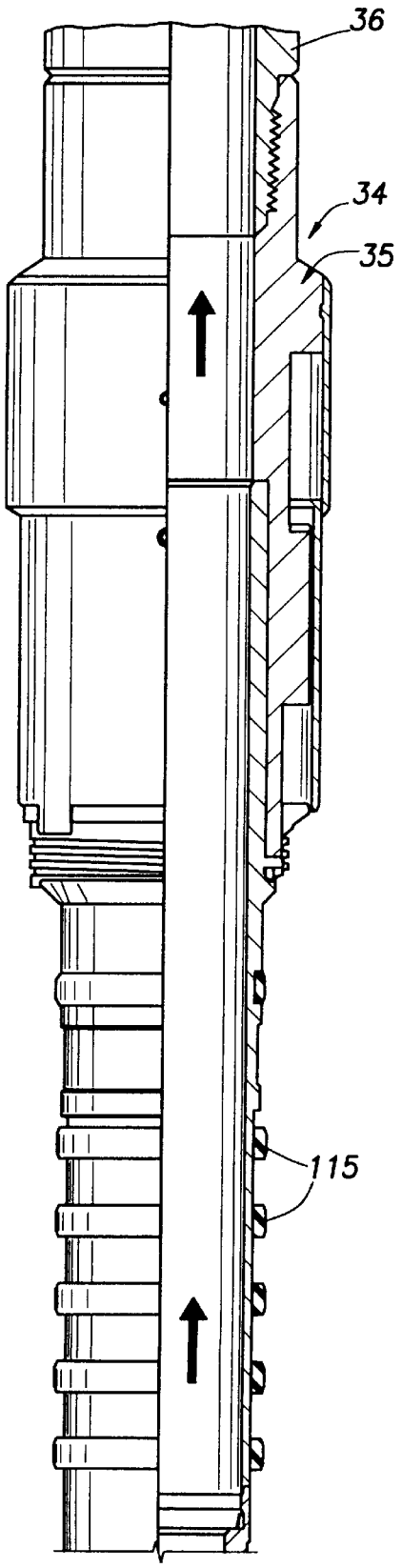
FIGS. 7A and 7B are sequential sectional views of the service tool in a reverse position with the service tool raised out of engagement with the bottom hole assembly to allow the upward flow of fluid within the interior of the tool string for unseating the ball.
Figure 7B:
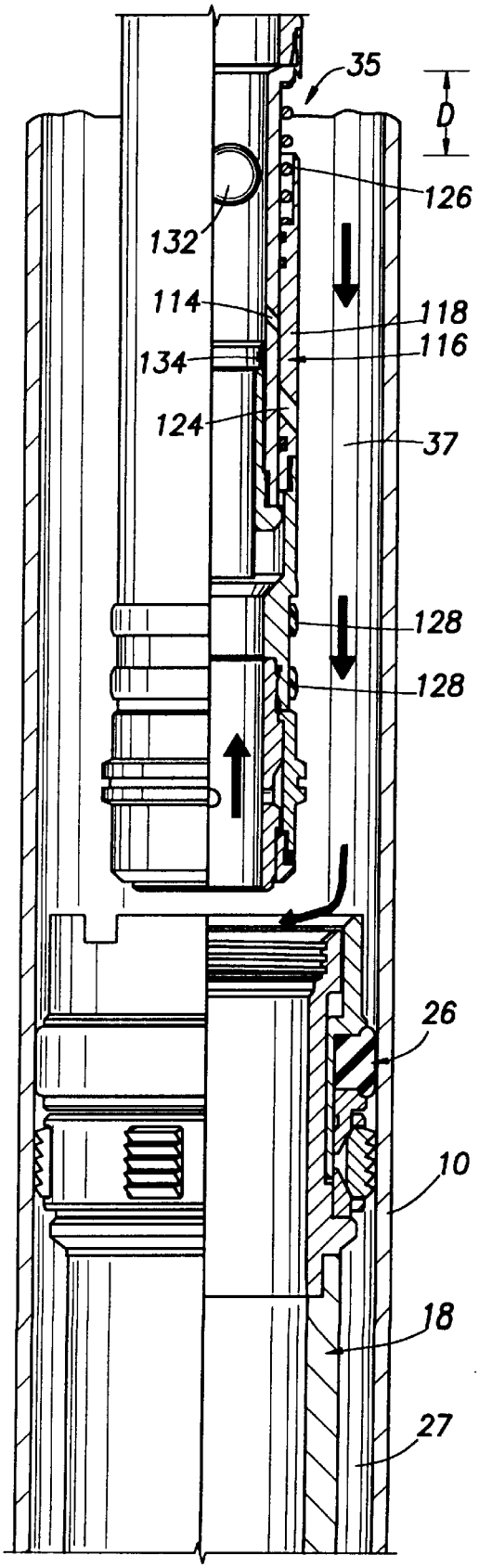

Fracturing fluid flows down the annulus 27 between the bottom hole assembly 18 and casing 10 to the production zone for flow through perforations 22 in perforated casing section 23 into the formation. Ball 132 on ball catcher 134 diverts the fracturing fluid through aligned ports 114, 124 and 88 into annulus 27. After the fracturing fluid has flowed into the formation under a predetermined pressure at a predetermined flow rate for a time sufficient to open the fissures, tool string 34 is lifted to a reverse position as shown in FIGS. 7A and 7B. In the reverse position, tool 35 is lifted above the bottom hole assembly 18 as shown in FIGS. 7A and 7B and a suitable slurry is pumped down annulus 37 for removal of the fracturing fluid from the service tool string 36. Diverter ball 132 is lifted from ball catcher 134 by the upward fluid flow and moves upwardly with the fluid within the bore of the tool string 102 for removal from the tool string 34.

Figure 10:
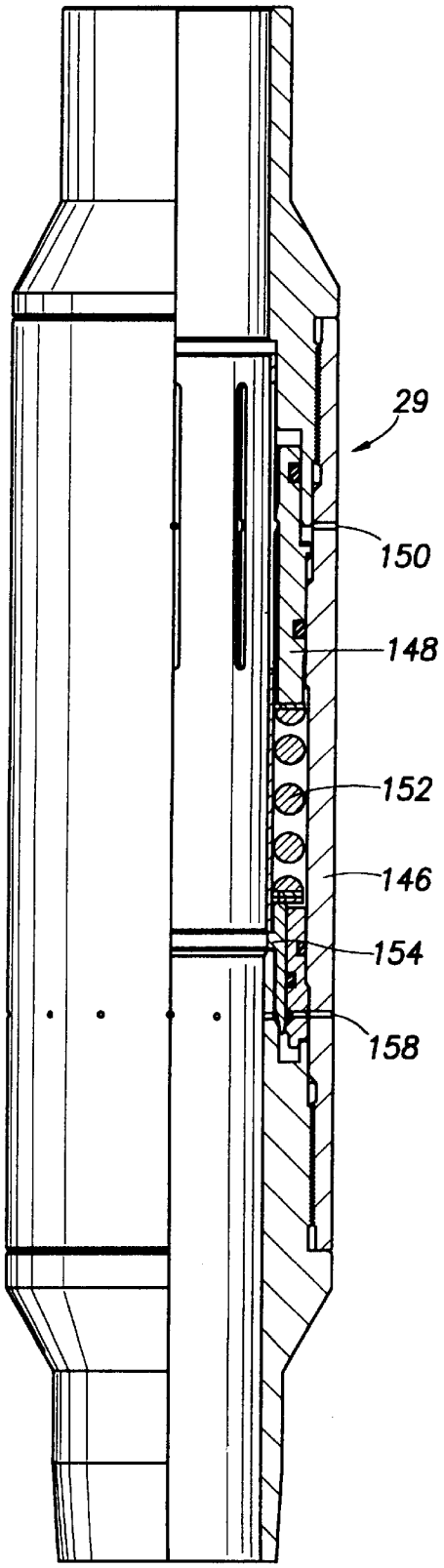
FIG. 10 is an enlarged sectional view of the equalizing valve adjacent the sand screen showing the relief valve in an intermediate operable position.
Figure 11:
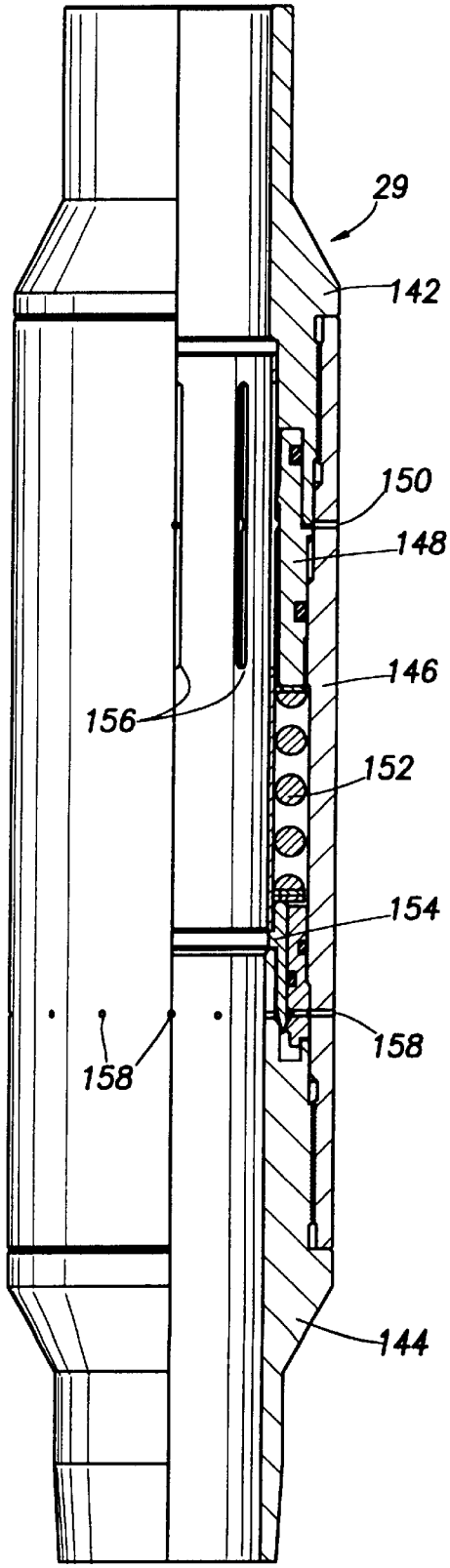
FIG. 11 is a sectional view similar to FIG. 10 showing the relief valve in an open position.
Figure 12:
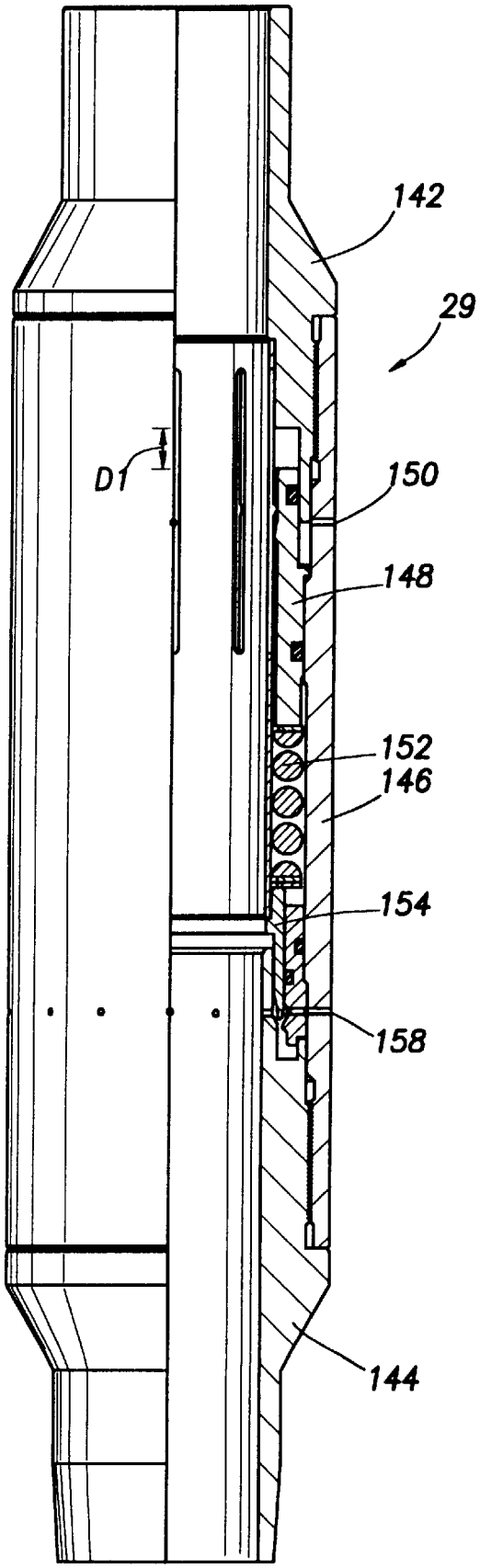
FIG. 12 is a sectional view similar to FIGS. 10 and 11 but showing the relief valve in a closed position.

To equalize the fluid pressure within bottom hole assembly 18 with the fluid pressure outside bottom hole assembly 18 in the annulus 27 adjacent sand screen 28 for effective operation of the reverse position shown in FIGS. 7A and 7B, equalizing valve 29 is provided above slidable sleeve 42 as shown schematically in FIGS. 1 and 2E, and specifically in FIGS. 10–12. By equalizing the internal pressure within bottom hole assembly 18 with the external fluid pressure in the adjacent formation, the reversing fluid is easily directed from annulus 37 above bottom hole assembly 18 into the lower end of tool 35 as shown in FIGS. 7A and 7B. The equalizing valve 29 shown in FIGS. 10–12 is mounted above slidable sleeve 42 as shown schematically in FIG. 2E. Equalizing valve 29 includes an upper sub 142 and a lower sub 144 with an outer housing 146 extending between subs 142 and 144. Lower sub 144 is connected to slidable sleeve 42. In some instances, an isolation tube may be utilized connecting sleeve 42. An upper operating piston is shown at 148 responsive to external fluid pressure from port 150. Spring 152 is mounted between piston 148 and an annular poppet valve generally indicated at 154. A collet 156 having collet fingers is provided adjacent operating piston 148 and is effective to transfer force from upper piston 148 to the concentric poppet valve 154. A plurality of fluid ports 158 are provided about the circumference of outer housing 146 and extend through housing 146 and sub 144 to the interior or bore of valve 29. Annular poppet valve 154 blocks fluid flow through ports 158 in the closed position shown in FIG. 11 in which the internal pressure is greater than or equal to the external pressure or external pressure is below the pressure required to force piston 148 over collet 156. When the external pressure exceeds the internal pressure, piston 148 responsive to a differential pressure actuates collet fingers 156 to counteract the load on valve 154 and hold poppet valve 154 closed. When piston 148 snaps over collet 156, valve 154 is allowed to move up a distance D1 to the position of FIG. 12 for opening of ports 158 to provide equalization of the internal and external pressures. Upon equalizing of external and internal fluid pressures, the internal fluid pressure and spring force acting against piston 148 recocks collet fingers 156 to return poppet valve 154 to the closed position of FIG. 11. FIG. 10 shows poppet valve 154 in a run in position for installation of equalizing valve 29 within bottom hole assembly 18 with collet fingers 156 transferring force between piston 148 and poppet valve 154. External pressure tends to push piston 148 down and valve poppet 154 up. The preload in spring 152 holds valve poppet 154 closed while piston 148 applies a greater load through collet 156. When collet 156 snaps, the piston 148 applied load is lost and poppet valve 154 opens.

After the reverse operation for a subsea well, tool string 34 is lifted around 400 feet from the sea floor for installation of the surface controlled subsurface safety valve shown generally at 164 by connection between pipe sections of tool string 34. The subsurface safety valve 164 includes suitable fluid connections for operation thereof from a surface location.

After insertion of subsurface safety valve 164, tool string 34 is then lowered as a production string into bottom hole assembly 18 as shown in FIGS. 9A and 9B. Tool string 34 is installed for production with production seals 115 engaging bottom hole assembly 18 as shown. In the producing position shown in FIGS. 9A and 9B slide valve assembly 116 is in an extended position and is positioned above slide valve member 90 and openings 88 in bottom hole assembly 18. Slide valve 44 shown particularly in FIG. 2F is moved mechanically to an open position of production openings 46 by a suitable shifting tool.

OPERATION

In operation, as shown particularly in FIG. 1 with casing section 23 previously perforated, bottom hole assembly 18 connected to service tool string 34 is lowered within the borehole adjacent pay zone 14. Lower packer assembly 24 is set above production zone 14 and upper packer assembly 26 is set above production zone 14.

A circulating position is shown in FIGS. 5A and 5B in which shoulder 129 of slidable valve assembly 116 on the end of tool 35 contacts shoulder 62 on upper packer sub 58 of bottom hole assembly 18. Contact of slidable valve assembly 116 with shoulder 62 moves sleeve assembly 116 upwardly relative to mandrel 114 for alignment of ports 114 and 124. In this position, ball 132 is dropped down the bore of tool string 34 and seats on ball catcher 134 for diverting the downward flow of circulating fluid through aligned ports 114 and 124 into annulus 37 between tool string 34 and casing 10 for suitable circulation of the fluid.

Next, the tool string 34 is lowered within bottom hole assembly 18 to the squeeze or gravel pack position shown in FIGS. 6A and 6B with slidable sleeve assembly 116 contacting annular shoulder 86 as shown in FIG. 6B to move slidable sleeve assembly 68 upwardly to a retracted position for alignment of ports 114 and 134 in a crossover position. In this position, fingers 92 are moved out of engagement with annular groove 96 and against abutment 97 by slidable sleeve assembly 68 for movement of slide valve 90 downwardly as shown in FIG. 6B for opening of ports 88 to communicate annulus 27 with the bore of tool string 34 through ports 114,124 and 88 in the crossover position. Fracturing fluid is diverted by ball 132 and the downward flow of pressurized fracturing fluid in annulus 27 is forced outwardly through the perforations 22 into the formation for hydraulic fracturing of pay zone 14 with a suitable proppant.

After the squeeze or gravel pack operation has been completed, tool string 34 is hydraulically released from bottom hole assembly 18 and raised to the reverse position shown in FIGS. 7A and 7B in which tool string 34 is positioned above the upper packer assembly 26. To allow fluid transfer, the equalizing valve shown at 29 in FIG. 1 and particularly in FIGS. 10–12 is actuated so that the fluid pressure within bottom hole assembly 18 is equalized with the fluid pressure outside bottom hole assembly 18. The flow of fluid in the reverse operation is down annulus 37 between the tool string 34 and casing 10 and up the bore of the tool string 34. Ball 132 moves upwardly with the fluid in the reverse position as shown in FIG. 7B and is removed from the service tool string 34.

Figure 8A:
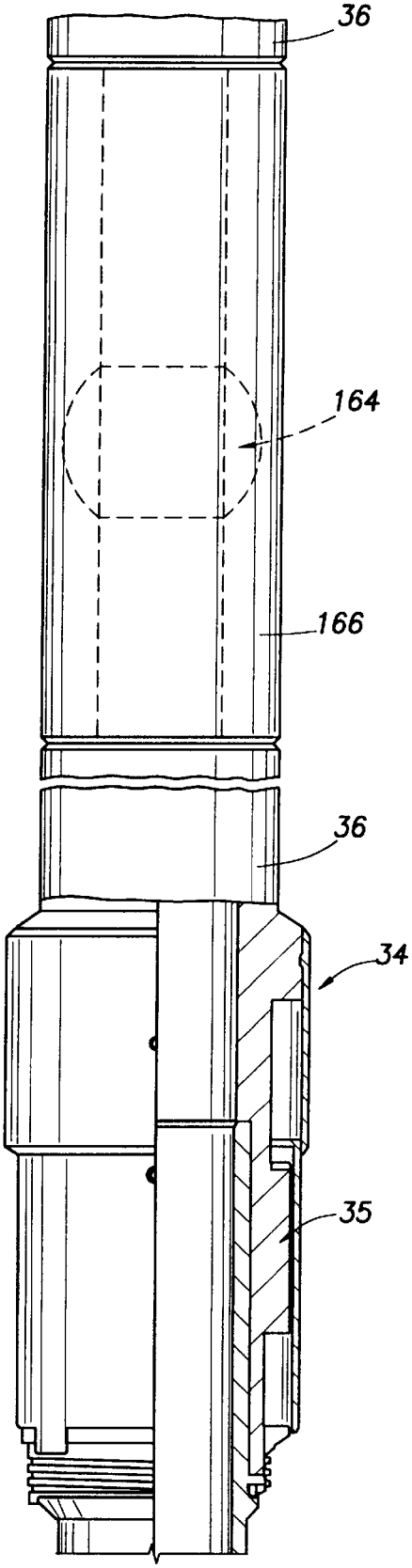
FIGS. 8A and 8B are sequential sectional views of the service tool raised above the bottom hole assembly to the depth location of the surface controlled subsurface safety valve for installation of the safety valve.
Figure 8B:
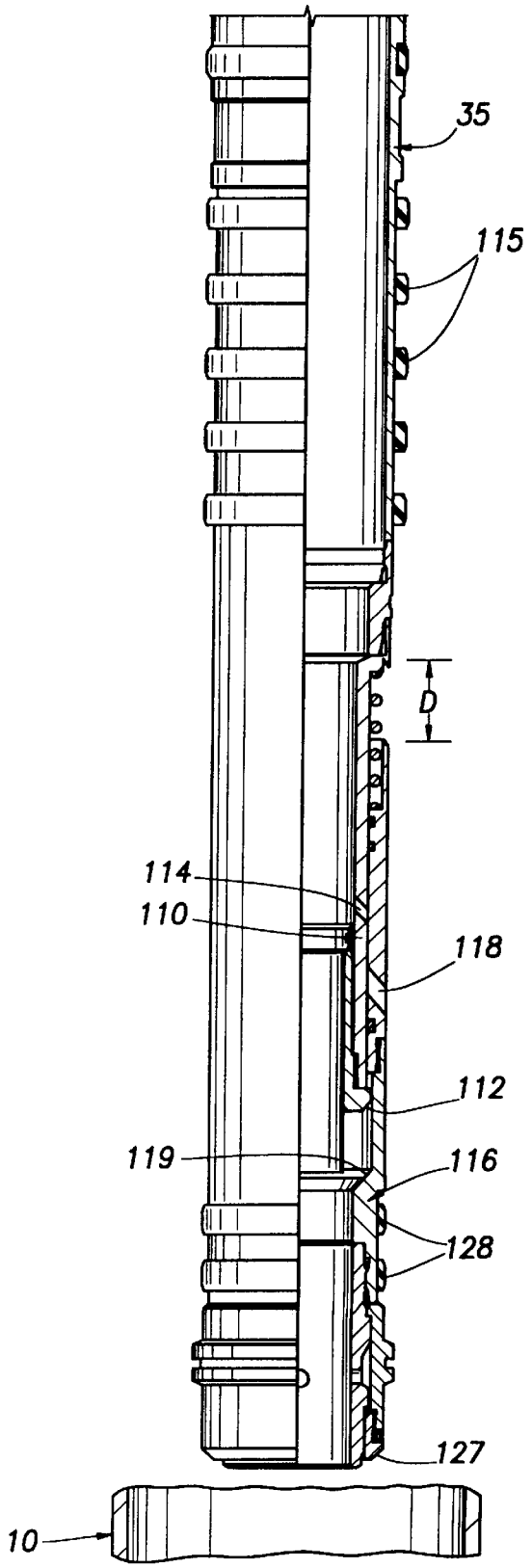

After the reverse operation, tool string 34 is lifted to a position for installation of a surface control subsurface safety valve such as shown at 164 in FIG. 8A. Tool string 34 may be lifted around 400 feet, for example, from the sea floor for a subsea well for installation of subsurface safety valve 164 at the desired height in service tool string 34 which becomes the production tool string. After installation of subsurface safety valve 164, the tool string 34 which also forms the production string is lowered into bottom hole assembly 18 as shown in FIGS. 9A and 9B for production with production seals 115 engaging the upper sub 62 of bottom hole assembly 18 and slidable valve assembly 116 in an extended position. Slide valve 44 is moved upwardly or downwardly by a suitable shifting tool to open openings 40 for production.

It is apparent from the above that the utilization of a service tool string as a production string is effective in eliminating a trip in the well which is normally provided from a rig. The tool or work string is not removed from the wellbore but forms the production string. The tool string 34 includes a slidable valve assembly 116 about the tool mandrel which moves by engagement of collet 130 to an extended position closing crossover ports 114, 124 in the tool mandrel 112 and slidable valve assembly 116. The crossover ports 114, 124 in the sliding valve assembly and the tool mandrel are aligned only when the lower end of slide valve assembly 116 is engaged and moved upwardly to a retracted position relative to the tool mandrel 112. Such an arrangement provides a highly effective valve assembly for the circulating position, the gravel pack position, and the reverse position. In the reverse position the service tool 35 is moved out of the upper packer assembly 26 of bottom hole assembly 18 to permit the reverse flow of fluid for removal of any proppant or the like from tool string 34. A diverter 102 is easily moved upwardly with the reverse flow of fluid for removal from the service tool string 34. An equalizer valve 29 as shown in FIGS. 10–12 is effective to equalize the fluid pressure within bottom hole assembly 18 as service tool 35 is moved between operational positions. The production seals 115 and 128 are easily carried by the service tool 35.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. Apparatus for a one trip gravel pack and production system in which a single tubing string within an outer casing of a borehole is utilized as a work string during fluid fracturing of a production zone adjacent a perforated casing section and then utilized as a production string after fracturing of said production zone; said apparatus comprising:

a bottom hole assembly within the casing having an outer housing with an upper packer assembly above the production zone, a lower packer assembly below the production zone, with the upper packer assembly and the lower packer assembly being used for sealing an annulus between the bottom hole assembly and the casing, a screen adjacent a perforated section of the casing in the production zone, and a crossover port in said outer housing extending to said annulus;

a service tool having a lower end, being suspended from the tubing string, being releasably connected at said lower end to said bottom hole assembly and having a mandrel and an outer slide valve assembly mounted about said mandrel, said mandrel and said outer slide valve assembly each having a crossover port therein; and means providing relative axial movement between said mandrel and said outer slide valve assembly carried thereby to permit alignment of said crossover ports for said mandrel and said outer slide valve assembly with said crossover port of said outer housing for flow of fracturing fluid down said annulus into said production zone in a fracturing operation.

2. Apparatus as set forth in claim 1 wherein said outer slide value assembly is mounted on said mandrel for movement between a retracted position in which said crossover ports in said mandrel and said said outer slide value assembly are aligned for fluid flow therethrough and an extended position in which said crossover ports are out of alignment to block fluid flow therethrough.

3. Apparatus as set forth in claim 2 wherein abutment means on said bottom hole assembly engages said slide outer valve assembly upon downward movement of said mandrel within said bottom hole assembly for effecting movement of said slide outer valve assembly to a retracted position in which said crossover ports in said mandrel and said outer slide valve assembly are aligned.

4. Apparatus as set forth in claim 2 wherein means permit movement of said outer slide valve assembly to an extended position on said mandrel when said outer slide valve assembly is disengaged from said bottom hole assembly for blocking fluid communication between said crossover ports in said mandrel and said slide valve assembly.

5. Apparatus as set forth in claim 1 wherein said bottom hole assembly has a slide valve over said crossover port therein to close said crossover port; and said outer slide valve assembly is effective to move said slide valve from said crossover port to open said crossover port in said bottom hole assembly in a crossover position for the fracturing operation.

6. Apparatus as set forth in claim 1 wherein said mandrel has a bore a diverter seat is mounted in the bore of said mandrel adjacent said crossover port in said mandrel; and a diverter member on said diverter seat diverts fracturing fluid from the bore of said mandrel outwardly through the aligned crossover ports into said annulus during the fracturing operation.

7. Apparatus for a one trip gravel pack and production system in which a single tubing string within an outer casing of a borehole is utilized as a work string during fluid fracturing of a production zone adjacent a perforated casing section and then utilized as a production string after fracturing of said production zone; said apparatus comprising:

a bottom hole assembly within the casing having an outer housing with an upper packer assembly above the production zone, a lower packer assembly below the production zone, with the upper packer assembly and the lower packer assembly being used for sealing an annulus between the bottom hole assembly and the casing, a screen adjacent a perforated section of the casing in the production zone, and a crossover port in said outer housing extending to said annulus;

a service tool having a lower end, being suspended from the tubing string, being releasably connected at said lower end to said bottom hole assembly and having a mandrel and an outer slide valve assembly mounted about said mandrel, said mandrel and said outer slide valve assembly each having a crossover port therein; and means providing relative axial movement between said mandrel and said outer slide valve assembly carried thereby to permit alignment of said crossover ports for said mandrel and said outer slide valve assembly with said crossover port of said outer housing for flow of fracturing fluid down said annulus into said production zone in a fracturing operation;

wherein said outer slide valve assembly is mounted on said mandrel for movement between a retracted position in which said crossover ports in said mandrel and said outer slide valve assembly are aligned for fluid flow therethrough and an extended position in which said crossover ports are out of alignment to block fluid flow therethrough; and wherein abutment means on said bottom hole assembly adjacent said upper packer assembly engages said outer slide valve assembly upon downward movement of said mandrel for effecting movement of said outer slide valve assembly to a retracted position in which said crossover ports for said mandrel and said outer slide valve assembly are aligned at a position above said bottom hole assembly for the diverting of fluid flow down the tubing string outwardly through said aligned crossover ports into the annulus between said service tool and said casing for upward flow of fluid in said annulus in a circulating position of the apparatus.

8. Apparatus as set forth in claim 7 wherein said mandrel has a bore a diverter seat is mounted in the bore of said mandrel adjacent said crossover port in said mandrel, and a diverter member on said diverter seat diverts fluid from the bore of said mandrel outwardly through the aligned crossover ports into the annulus between said service tool and said casing at a position above said upper packer assembly.

9. Apparatus for a one trip gravel pack and production system in which a single tubing string within an outer casing of a borehole is utilized as a work string during fluid fracturing of a production zone adjacent a perforated casing section and then utilized as a production string after fracturing of said production zone; said apparatus comprising:

a bottom hole assembly within the casing having an outer housing with an upper packer assembly above the production zone, a lower packer assembly below the production zone, with the upper packer assembly and the lower packer assembly being used for sealing an annulus between the bottom hole assembly and the casing, a screen adjacent a perforated section of the casing in the production zone, and a crossover port in said outer housing extending to said annulus;

a service tool having a lower end, being suspended from the tubing string, being releasably connected at said lower end to said bottom hole assembly and having a mandrel and an outer slide valve assembly mounted about said mandrel, said mandrel and said outer slide valve assembly each having a crossover port therein; and means providing relative axial movement between said mandrel and said outer slide valve assembly carried thereby to permit alignment of said crossover ports for said mandrel and said outer slide valve assembly with said crossover port of said outer housing for flow of fracturing fluid down said annulus into said production zone in a fracturing operation;

wherein said service tool is lifted to a location above said upper packer assembly in a reverse position after fracturing of the production zone; and an equalizing valve is provided in said bottom hole assembly to equalize the external fluid pressure outside the bottom hole assembly with the internal fluid pressure inside the bottom hole assembly so that the flow of fluid in the annulus between the service tool and the casing above the bottom hole assembly is easily directed into the bore of the tubing string above the upper packer assembly for upward flow to a surface location in a reverse position after the fracturing operation.

10. Apparatus for a one trip gravel pack and production system in which a single tubing string within an outer casing in a borehole is utilized as a work string during fluid fracturing of a production zone adjacent a perforated casing section and then utilized as a production string after fracturing of said production zone; said apparatus comprising:

a bottom hole assembly within the casing having an outer housing with an upper packer assembly above the production zone;

a service tool suspended from said tubing string and positioned in a reverse operation after fracturing at a location above said upper packer assembly of said bottom hole assembly for the downward flow of fluid down the annulus between said tool and said casing at a position above the upper packer assembly; and an equalizing valve in said bottom hole assembly to equalize the external fluid pressure outside the bottom hole assembly with the internal fluid pressure inside the bottom hole assembly;

the downward flow of fluid in the annulus between said service tool and said casing being directed upwardly into a bore at the bottom of said service tool at a position above said upper packer assembly for upward flow of fluid in said tubing string to a surface location.

11. Apparatus as set forth in claim 10 wherein said equalizing valve comprises an outer tubular housing and a plurality of ports extending through said outer housing to the interior of said bottom hole assembly, an annular valve member carried by said housing and positioned across said ports to block fluid flow through said ports in a closed position and to permit fluid flow in an open position through said ports from outside said bottom hole assembly to inside said bottom hole assembly, said valve member movable to an open position when external fluid pressure outside said bottom hole assembly exceeds internal fluid pressure inside said bottom hole assembly in a reverse operation of said apparatus after fracturing of the production zone for equalizing the internal and external fluid pressures.

12. Apparatus as set forth in claim 11 wherein said equalizing valve has a piston urging said annular valve member to an open position, said piston responsive to external fluid pressure outside said bottom hole assembly.

13. A gravel pack apparatus suspended within a casing from a production tubing string for gravel packing a production zone of a wellbore and for producing from the wellbore through said production tubing after gravel packing in a single trip of said tubing string within said wellbore; said gravel pack apparatus comprising:

a bottom hole assembly including an upper packer assembly above the production zone, a lower packer assembly below the production zone for sealing an annulus between the bottom hole assembly and the casing, and a screen adjacent a perforated section of the casing in the production zone;

a service tool having a lower end and an upper end, being releasably connected at said lower end to said bottom hole assembly, connected at said upper end to the production tubing string and having production seals thereon for sealing against said bottom hole assembly when said service tool is assembled onto said bottom hole assembly for production;

said service tool carrying a crossover assembly having a ball seat for a movable diverter member, a lateral opening above said ball seat, and a slidable sleeve about said lateral opening having a crossover port for alignment with said lateral opening in one position to permit the downward flow of a slurry within the tubing string outwardly into the annulus between said bottom hole assembly and casing below said upper packer assembly and into the production zone for packing thereof; the downward flow of slurry maintaining said diverter member on said ball seat; and said service tool being operatively connected to said bottom hole assembly during packing of said production zone, said service tool being operatively disconnected from said bottom hole assembly after packing of said production zone and raised to a position above said upper packing assembly for reversing of fluid flow with fluid flow being down the annulus between said casing and said service tool and then up said service tool at a location above said upper packer assembly for unseating of said diverter member and movement of said diverter member upwardly with said fluid flow.

14. The gravel pack apparatus as set forth in claim 13 wherein a plurality of annular production seals are positioned about said service tool, said service tool being lowered within said bottom hole assembly after reversing of fluid flow or sealing engagement of said annular production seals with said bottom hole assembly for production.

15. The gravel pack apparatus as set forth in claim 13 wherein said bottom hole assembly has an outer housing with a crossover port therein alignable with said lateral opening and crossover port in said slidable sleeve in a fracturing position of said apparatus.

16. The gravel pack apparatus as set forth in claim 15 wherein a slidable valve member is effective to open said crossover port in said outer housing in the fracturing operation.

17. A gravel pack apparatus suspended within a casing from a production tubing string for gravel packing a production zone of a wellbore and for producing from the wellbore through said production tubing after gravel packing in a single trip of said tubing string within said wellbore; said gravel pack apparatus comprising:

a bottom hole assembly including an upper packer assembly above the production zone, a lower packer assembly below the production zone for sealing an annulus between the bottom hole assembly and the casing, and a screen adjacent a perforated section of the casing in the production zone;

a service tool having a lower end and an upper end, being releasably connected at said lower end to said bottom hole assembly, being connected at said upper end to the production tubing string and having production seals thereon for sealing against said bottom hole assembly when said service tool is assembled onto said bottom hole assembly for production;

said service tool carrying a crossover assembly having a ball seat for a movable diverter member, a lateral opening above said ball seat, and a slidable sleeve about said lateral opening having a crossover port for alignment with said lateral opening in one position to permit the downward flow of a slurry within the tubing string outwardly into the annulus between said bottom hole assembly and casing below said upper packer assembly and into the production zone for packing thereof; the downward flow of slurry maintaining said diverter member on said ball seat; and said service tool being operatively connected to said bottom hole assembly during packing of said production zone, said service tool being operatively disconnected from said bottom hole assembly after packing of said production zone and raised to a position above said upper packing assembly for reversing of fluid flow with fluid flow being down the annulus between said casing and said service tool and then up said service tool at a location above said upper packer assembly for unseating of said diverter member and movement of said diverter member upwardly with said fluid flow;

wherein an isolation sleeve is positioned concentrically inwardly of said screen to isolate the production zone from the bore of the bottom hole assembly; and wherein a valve is positioned in said isolation sleeve for movement to an open position when external fluid pressure outside said bottom hole assembly is greater than the internal fluid pressure within said bottom hole assembly to equalize the internal fluid pressure with the external fluid pressure.

18. A method for packing a production zone of a wellbore and for producing from said production zone after packing in a single trip of a service tool and tubing string within the borehole; said method comprising the steps of:

lowering a bottom hole assembly within the borehole from the service tool and tubing string;

setting an upper packer assembly against a casing in the borehole at opposed sides of the production zone;

providing a crossover assembly for the service tool having a mandrel and including a crossover port in the mandrel and a crossover port in a slide valve assembly that is carried by said mandrel and that is mounted about said mandrel for relative axial movement;

providing a stop on said bottom hole assembly for contacting said slide valve assembly upon lowering of said mandrel within said bottom hole assembly for fracturing of said production zone; and lowering said mandrel within said bottom hole assembly for injecting fracturing fluid in the annulus between said bottom hole assembly and said casing with said slide valve assembly contacting said stop and moving said slide valve assembly and crossover port therein to an aligned position with said crossover port in said mandrel to provide fluid flow from the bore of said mandrel outwardly through said aligned crossover ports in said mandrel and slide valve assembly into the annulus for downward flow into the production zone in the packing position of the service tool.

19. The method as set forth in claim 18 including the steps of:

providing a diverter seat within said mandrel adjacent said crossover port therein; and dropping a-diverter member down said tubing string for seating on said diverter seat to divert fluid flow outwardly from the bore of said mandrel into said annulus for downward flow.

20. A method as set forth in claim 18 including the steps of:

raising said service tool and tubing string after fracturing of said production zone to a position above said upper packing assembly of said bottom hole assembly; and then reversing the flow of fluid to provide fluid flow down the annulus between the service tool and the casing above the bottom hole assembly and then up the service tool and tubing string at a location above the bottom hole assembly.

21. The method as set forth in claim 19 including the steps of:

raising said service tool and tubing string after fracturing of said production zone to a position adjacent the upper packing assembly of said bottom hole assembly; and then reversing the flow of fluid to provide fluid flow down the annulus between the service tool and the casing, and then up the service tool and tubing string with a ball being carried upwardly in the tubing string for removal by the upward fluid flow in the service tool.

22. A method for packing a production zone of a wellbore and for producing from said production zone after packing in a single trip of a service tool and tubing string within the borehole; said method comprising the steps of:

lowering a bottom hole assembly within the borehole from the service tool and tubing string;

setting an upper packer assembly against a casing in the borehole at opposed sides of the production zone;

providing a crossover assembly for the service tool having a mandrel and including a crossover port in the mandrel and a crossover port in a slide valve assembly that is carried by said mandrel and that is mounted about said mandrel for relative axial movement;

providing a stop on said bottom hole assembly for contacting said slide valve assembly upon lowering of said mandrel within said bottom hole assembly for fracturing of said production zone;

lowering said mandrel within said bottom hole assembly for injecting fracturing fluid in the annulus between said bottom hole assembly and said casing with said slide valve assembly contacting said stop and moving said slide valve assembly and crossover port therein to an aligned position with said crossover port in said mandrel to provide fluid flow from the bore of said mandrel outwardly through said aligned crossover ports in said mandrel and slide valve assembly into the annulus for downward flow into the production zone in the packing position of the service tool;

raising said service tool and tubing string after fracturing of said production zone to a position above said upper packing assembly of said bottom hole assembly;

reversing the flow of fluid to provide fluid flow down the annulus between the service tool and the casing above the bottom hole assembly and then up the service tool and tubing string at a location above the bottom hole assembly; and equalizing an internal fluid pressure inside the bottom hole assembly with an external fluid pressure outside the bottom hole assembly in the reverse position of the service tool.

23. A method for packing a production zone of a wellbore and for producing from said production zone after packing in a single trip of a service tool and tubing string within the borehole; said method comprising the steps of:

lowering a bottom hole assembly within the borehole from the service tool and tubing string;

setting an upper packer assembly against a casing in the borehole at opposed sides of the production zone;

providing a crossover assembly for the service tool having a mandrel and including a crossover port in the mandrel and a crossover port in a slide valve assembly that is carried by said mandrel and that is mounted about said mandrel for relative axial movement;

providing a stop on said bottom hole assembly for contacting said slide valve assembly upon lowering of said mandrel within said bottom hole assembly for fracturing of said production zone;

lowering said mandrel within said bottom hole assembly for injecting fracturing fluid in the annulus between said bottom hole assembly and said casing with said slide valve assembly contacting said stop and moving said slide valve assembly and crossover port therein to an aligned position with said crossover port in said mandrel to provide fluid flow from the bore of said mandrel outwardly through said aligned crossover ports in said mandrel and slide valve assembly into the annulus for downward flow into the production zone in the packing position of the service tool;

providing a diverter seat within said mandrel adjacent said crossover port therein and dropping a diverter member down said tubing string for seating on said diverter seat to divert fluid flow outwardly from the bore of said mandrel into said annulus for downward flow;

raising said service tool and tubing string after fracturing of said production zone to a position adjacent the upper packing assembly of said bottom hole assembly;

reversing the flow of fluid to provide fluid flow down the annulus between the service tool and the casing, and then up the service tool and tubing string with a ball being carried upwardly in the tubing string for removal by the upward fluid flow in the service tool;

raising said service tool and tubing string after fracturing of said production zone to a position above said upper packing assembly of said bottom hole assembly; and equalizing an internal fluid pressure inside the bottom hole assembly with an external fluid pressure outside the bottom hole assembly in the reverse position of the service tool.

24. A method for packing a production zone of a wellbore and for producing from said production zone after packing in a single trip of a service tool and tubing string within the borehole; said method comprising the steps of:

lowering a bottom hole assembly within the borehole from the service tool and tubing string;

setting an upper packer assembly against a casing in the borehole at opposed sides of the production zone;

providing a crossover assembly for the service tool having a mandrel and including a crossover port in the mandrel and a crossover port in a slide valve assembly that is carried by said mandrel and that is mounted about said mandrel for relative axial movement;

providing a stop on said bottom hole assembly for contacting said slide valve assembly upon lowering of said mandrel within said bottom hole assembly for fracturing of said production zone;

lowering said mandrel within said bottom hole assembly for injecting fracturing fluid in the annulus between said bottom hole assembly and said casing with said slide valve assembly contacting said stop and moving said slide valve assembly and crossover port therein to an aligned position with said crossover port in said mandrel to provide fluid flow from the bore of said mandrel outwardly through said aligned crossover ports in said mandrel and slide valve assembly into the annulus for downward flow into the production zone in the packing position of the service tool;

reversing the flow of fluid after the fracturing operation to provide fluid flow down the annulus between the service tool and casing and then up the service tool;

raising the service tool and tubing string to a predetermined height above said bottom hole assembly for a surface controlled subsurface safety valve;

inserting said surface controlled subsurface safety valve within said tubing string at a predetermined location; and then lowering said service tool and tubing string in said bottom hole assembly to a producing position for production through said service tool and said tubing string.

25. A method for packing a production zone of a wellbore utilizing a bottom hole assembly suspended within a casing from a service tool on a tubing string for producing fluid from the wellbore through said tubing string and said service tool, said method for packing the production zone and producing from the production zone being accomplished in a single trip of the tubing string within the borehole; said method comprising the steps of:

lowering the tubing string within the borehole along with the service tool and bottom hole assembly;

setting an upper packer assembly carried by said bottom hole assembly adjacent the production zone;

providing a crossover assembly for said service tool including crossover ports movable to an open position to permit fluid flow from a bore of said service tool to the annulus between the bottom hole assembly and the casing, the crossover assembly movable to a closed position blocking alignment of said crossover ports to block fluid flow from the bore of said service tool to the annulus between the bottom hole assembly and the casing;

dropping a diverter member down said tubing string for seating on a seat within the service tool for blocking fluid flow down service tool and diverting fluid flow in an open position of said crossover assembly from the bore of said service tool through said crossover ports to said annulus for packing of said production zone with a suitable gravel pack slurry;

raising said service tool after packing of said production zone to a position adjacent the upper packer assembly;

then reversing the flow of fluid in a reverse position to provide fluid flow down the annulus above the upper packer assembly between the service tool and the casing, and then up the service tool and tubing string with said diverter member being carried upwardly by the upward fluid flow in the service tool;

lowering the service tool within the bottom hole assembly for connection to said bottom hole assembly in sealing relation in a producing position; and then producing from said production zone through said service tool and tubing string.

26. The method as set forth in claim 25 including the steps of:

providing a slidable sleeve for said crossover assembly having a crossover port therein alignable with a crossover port in a mandrel of said tool;

mounting said sleeve for movement to a closed position when said service tool is not engaged with said bottom hole assembly; and providing a stop in said bottom hole assembly for engagement by said sleeve when said tool is lowered within said bottom hole assembly with said tool moving downwardly relative to said sleeve to said open position of said crossover ports.

27. The method as set forth in claim 26 including the step of:

providing an upper stop in said bottom hole assembly for engagement with said sleeve in a circulating position With said diverter member seated on said seat at a position above said upper packing assembly.

28. The method as set forth in claim 26 including the step of:

providing a lower stop in said bottom hole assembly for engagement with said sleeve in the reverse position with said diverter member seated on said seat at a position below said upper packing assembly.

29. A method for packing a production zone of a wellbore utilizing a bottom hole assembly suspended within a casing from a service tool on a tubing string for producing fluid from the wellbore through said tubing string and said service tool, said method for packing the production zone and producing from the production zone being accomplished in a single trip of the tubing string within the borehole; said method comprising the steps of:

lowering the tubing string within the borehole along with the service tool and bottom hole assembly;

setting an upper packer assembly carried by said bottom hole assembly adjacent the production zone;

providing a crossover assembly for said service tool including crossover ports movable to an open position to permit fluid flow from a bore of said service tool to the annulus between the bottom hole assembly and the casing, the crossover assembly movable to a closed position blocking alignment of said crossover ports to block fluid flow from the bore of said service tool to the annulus between the bottom hole assembly and the casing;

dropping a diverter member down said tubing string for seating on a seat within the service tool for blocking fluid flow down service tool and diverting fluid flow in an open position of said crossover assembly from the bore of said service tool through said crossover ports to said annulus for packing of said production zone with a suitable gravel pack slurry;

raising said service tool after packing of said production zone to a position adjacent the upper packer assembly;

reversing the flow of fluid in a reverse position to provide fluid flow down the annulus above the upper packer assembly between the service tool and the casing, and then up the service tool and tubing string with said diverter member being carried upwardly by the upward fluid flow in the service tool;

lowering the service tool within the bottom hole assembly for connection to said bottom hole assembly in sealing relation in a producing position;

producing from said production zone through said service tool and tubing string;

raising said service tool and tubing string from said reverse position to a predetermined location above said bottom hole assembly for a surface controlled subsurface safety valve;

inserting said surface controlled subsurface safety valve within said tubing string at said predetermined location; and then lowering said service tool within said bottom hole assembly for connection to said bottom hole assembly in a producing position.

* * * * *

UNITED STATES PATENT AND TRADEMARK OFFICE

CERTIFICATE OF CORRECTION

PATENT NO. : 6,216,785 B1
DATED : April 17, 2001
INVENTOR(S) : Timothy T. Achee Jr. et al.

It is certified that error appears in the above-identified patent and that said Letters Patent is hereby corrected as shown below:

Title page,
Item [75], Inventors, delete "Harold S. Bissonette", and insert
-- Harold S. Bissonnette. --.

Signed and Sealed this

Twelfth Day of August, 2003

JAMES E. ROGAN
*Director of the United States Patent and Trademark Office*